US009500408B2

(12) United States Patent
Spangler et al.

(10) Patent No.: US 9,500,408 B2
(45) Date of Patent: Nov. 22, 2016

(54) MOBILE VENEER DRYER

(71) Applicant: USNR, LLC, Woodland, WA (US)

(72) Inventors: Clinton Spangler, Mentor, OH (US); Conrad Bullion, La Center, WA (US)

(73) Assignee: USNR, LLC, Woodland, WA (US)

( * ) Notice: Subject to any disclaimer, the term of this patent is extended or adjusted under 35 U.S.C. 154(b) by 17 days.

(21) Appl. No.: 14/070,228

(22) Filed: Nov. 1, 2013

(65) Prior Publication Data

US 2015/0121714 A1 May 7, 2015

(51) Int. Cl.
*F26B 21/06* (2006.01)
*F26B 15/12* (2006.01)

(52) U.S. Cl.
CPC ..... *F26B 15/122* (2013.01); *F26B 2210/14* (2013.01); *Y10T 29/4984* (2015.01)

(58) Field of Classification Search
CPC ..... F26B 15/00; F26B 15/10; F26B 25/00; F26B 25/08; B65H 16/00; B65H 16/10
USPC ..... 34/396, 500, 168, 172, 174; 118/210; 414/812, 477, 522; 242/528, 613.1
See application file for complete search history.

(56) References Cited

U.S. PATENT DOCUMENTS 2,708,783 A * 5/1955 Ripley ..... B28B 5/04 264/294
3,098,514 A * 7/1963 Rados ..... B27M 3/0053 144/242.1
3,399,445 A * 9/1968 Carroll ..... B27M 3/0073 221/11
5,743,026 A * 4/1998 Cremona ..... F26B 13/101 34/639
5,815,945 A * 10/1998 Ando ..... F26B 3/305 34/212

(Continued)

FOREIGN PATENT DOCUMENTS

CA 2413619 A1 7/1979
CA 1278186 C 12/1990

(Continued)

OTHER PUBLICATIONS

Canadian Examiner's Report for 2,832,193 mailed Jan. 26, 2015.

(Continued)

*Primary Examiner* — Stephen M Gravini
(74) *Attorney, Agent, or Firm* — Schwabe Williamson & Wyatt, P.C.

(57) ABSTRACT

Embodiments provide a veneer dryer system and methods of constructing, relocating, and replacing veneer dryers and other constructs such as lumber kilns, machinery, and processing lines or parts thereof. Embodiments of a veneer dryer system may include a track and a veneer dryer movably coupled with the track. The track may extend between the desired location of the veneer dryer and a construction location. Movers may be coupled with the track at the construction location. The veneer dryer may be partially or fully constructed on the movers and moved to the desired location for use. A pre-existing veneer dryer at the desired location may remain operational during the construction and removed before the new veneer dryer is moved into place, substantially reducing downtime and costs as compared to prior methods of replacing veneer dryers.

30 Claims, 18 Drawing Sheets

(56) References Cited

U.S. PATENT DOCUMENTS

| | | | | | |
|---|---|---|---|---|---|
| 5,836,086 | A * | 11/1998 | Elder | F26B 3/04 | 34/396 |
| 5,875,710 | A * | 3/1999 | Honda | B27D 3/02 | 100/196 |
| 5,881,476 | A * | 3/1999 | Strobush | F26B 13/10 | 34/210 |
| 5,915,811 | A * | 6/1999 | DeVore | F26B 3/286 | 34/212 |
| 5,960,563 | A * | 10/1999 | Kuboyama | A23N 12/08 | 34/589 |
| 7,963,048 | B2 * | 6/2011 | Pollard | F26B 15/12 | 110/315 |
| 7,987,614 | B2 * | 8/2011 | Erickson | F26B 7/00 | 100/50 |
| 8,161,663 | B2 * | 4/2012 | Weisselberg | C10L 9/083 | 202/109 |
| 8,196,310 | B2 * | 6/2012 | McMahon | F26B 21/10 | 156/220 |
| 8,397,400 | B2 * | 3/2013 | Choo | B27K 1/00 | 110/244 |
| 8,875,414 | B2 * | 11/2014 | Blomquist | F26B 3/04 | 104/172.3 |
| 2003/0015621 | A1 * | 1/2003 | Ohshio | B65H 16/06 | 242/528 |
| 2005/0132924 | A1 * | 6/2005 | Bothun | A47B 53/02 | 104/307 |
| 2015/0121714 | A1 * | 5/2015 | Spangler | F26B 15/122 | 34/201 |

FOREIGN PATENT DOCUMENTS

| | | | |
|---|---|---|---|
| CA | 2225081 | A1 | 6/1998 |
| CA | 2343300 | A1 | 4/2000 |
| CA | 2701007 | A1 | 9/2011 |
| CA | 2832193 | A1 | 1/2014 |

OTHER PUBLICATIONS

Examiner's Report from the Canadian Intellectual Property Office dated Oct. 8, 2014.

Examiner's Report from the Canadian Intellectual Property Office dated Jul. 2, 2014.

Examiner's Report from the Canadian Intellectual Property Office dated Jan. 14, 2014.

U.S. Natural Resources, Inc. USNR 6-Deck Jet Veneer Dryer—time lapse construction [online], Dec. 4, 2012 [retrieved on Mar. 25, 2014]. Retrieved from the Internet:< URL: http://www.youtube.com/watch?v=p73QQSZ4LOs> First 1 minute and 41 seconds were displayed at Timber Processing and Energy Expo on Oct. 17-18, 2012.

APA 2012 Innovator Appiication; submitted Jul. 10, 2012 to Engineemd Wood Technology Association.

U.S. Natural Resources, Inc., "Millwide Insider," 2013, distributed Jun. 6, 2013, issue 3, pp. 3-5.

U.S. Natural Resources, Inc,, "Millwide Insider," 2012, distributed Jan. 8, 2013, Issue 6 p. 3.

U.S. Natural Resources, Inc., "Millwide Insider," 2013, distributed Mar. 6, 2013, Issue 1, p. 11.

Engineered Wood Technology Association, "Engineered Wood Journal", Fall, 2012, p. 24.

Canadian Patent Application No. 2,911,958 Office Action dated Dec. 7, 2015, 3 pages.

Canadian Patent Application No. 2,911,958 Office Action dated Mar. 4, 2016, 3 pages.

Canadian Patent Application No. 2,911,958 Office Action dated Aug. 4, 2016, 3 pages.

* cited by examiner

MOBILE VENEER DRYER

TECHNICAL FIELD

Embodiments herein relate to the field of wood products machinery, and, more specifically, to veneer dryers and other large industrial machinery and methods of installing, translocating, and/or replacing veneer dryers and other large industrial machinery.

BACKGROUND

Veneer dryers are commonly used in the wood products industry to make products such as plywood and wood veneers. A typical veneer dryer is approximately 64-200 feet in length and about 25-30 feet in width, with four to six levels for conveying wood products to be dried. Conventional veneer dryers are constructed from mild steel and mounted on a concrete slab. Some modern veneer dryers have improvements such as insulated floors/walls, and may be mounted on expansion rollers to allow the dryers to expand in response to heating.

Veneer dryers are constructed in place. The construction window is typically at least 18-20 weeks. When the veneer dryer is constructed to replace an existing dryer at the same site, the existing dryer must be removed before construction of the new dryer begins. This leaves the facility without an operable dryer on the site for the duration of the disassembly and construction phases. Therefore, replacing an existing dryer can have a dramatic impact on the output and profitability of the facility.

BRIEF DESCRIPTION OF THE DRAWINGS

Embodiments will be readily understood by the following detailed description in conjunction with the accompanying drawings. Embodiments are illustrated by way of example and not by way of limitation in the figures of the accompanying drawings.

DETAILED DESCRIPTION OF DISCLOSED EMBODIMENTS

Figure 1A:
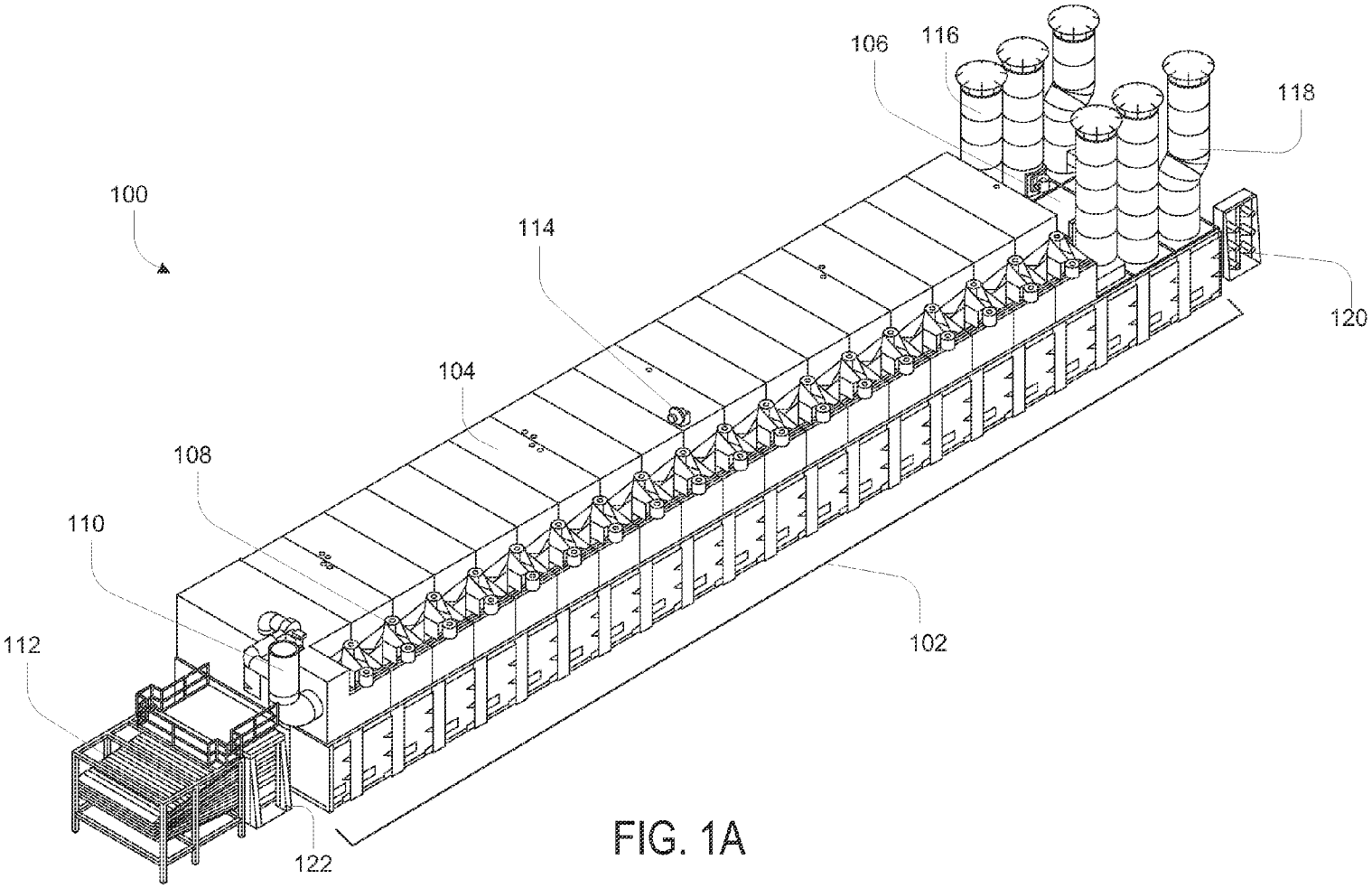
FIGS. 1A-1B illustrate perspective and bottom views of a veneer dryer and movers, in accordance with various embodiments.

In the following detailed description, reference is made to the accompanying drawings which form a part hereof, and in which are shown by way of illustration embodiments that may be practiced. It is to be understood that other embodiments may be utilized and structural or logical changes may be made without departing from the scope. Therefore, the following detailed description is not to be taken in a limiting sense, and the scope of embodiments is defined by the appended claims and their equivalents.

Various operations may be described as multiple discrete operations in turn, in a manner that may be helpful in understanding embodiments; however, the order of description should not be construed to imply that these operations are order dependent.

The description may use perspective-based descriptions such as up/down, back/front, and top/bottom. Such descriptions are merely used to facilitate the discussion and are not intended to restrict the application of disclosed embodiments.

The terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still cooperate or interact with each other.

For the purposes of the description, a phrase in the form "NB" or in the form "A and/or B" means (A), (B), or (A and B). For the purposes of the description, a phrase in the form "at least one of A, B, and C" means (A), (B), (C), (A and B), (A and C), (B and C), or (A, B and C). For the purposes of the description, a phrase in the form "(A)B" means (B) or (AB) that is, A is an optional element.

The description may use the terms "embodiment" or "embodiments," which may each refer to one or more of the same or different embodiments. Furthermore, the terms "comprising," "including," "having," and the like, as used with respect to embodiments, are synonymous.

Embodiments of methods, apparatuses, and systems relating to veneer dryers are described herein. In exemplary embodiments, a computing device may be endowed with one or more components of the disclosed apparatuses and/or systems and may be employed to perform one or more methods as disclosed herein.

In an exemplary plywood mill, the output of one veneer dryer may represent about 20% of the mill's weekly revenue. This can mean a loss of revenue on the order of $1-2 million dollars per week in some mills. As veneer dryers have become larger and more time-consuming to build, the loss of revenue due to downtime has also increased. Currently, lost revenue can be approximately one to three times the actual cost of the new veneer dryer.

Embodiments described herein provide movable veneer dryers that are configured to be moved intact from an initial construction site to a desired location of use. Other embodiments provide veneer dryer systems, veneer dryer installation systems, and methods for constructing, moving, and/or replacing a veneer dryer.

In some embodiments, a veneer dryer may be built at a construction site some distance away from the desired installation site. The veneer dryer may be a replacement for some or all of a pre-existing dryer, which may continue to be operated during the construction. When the new veneer dryer is constructed, the pre-existing dryer or portion thereof may be removed and the new veneer dryer may be towed to the installation site. This may be the same site that was occupied by the pre-existing dryer. Optionally, an infeed/outfeed section or other sections of the pre-existing dryer may be coupled with the new veneer dryer for further use. Constructing the veneer dryer offsite and towing it into place may reduce the time required for replacement of the pre-existing dryer from 18-20 weeks to 3 weeks or less, with a corresponding reduction in loss of revenue. In addition, embodiments described herein may allow the facility to choose the best time for replacing all or part of a pre-existing dryer. Such embodiments may also allow the facility to re-use an installation site or foundation, and to upgrade, retrofit, and/or elongate the pre-existing dryer at lower cost than was formerly possible.

In some embodiments, a veneer dryer may have an input end, an output end, and one or more decks extending between the input end and the output end. The veneer dryer may be modified/reinforced with one or more supports (e.g., braces) configured to increase the resistance of the veneer dryer to distortion or physical separation of components in response to the application of force (e.g., pushing/pulling). In some embodiments, a veneer dryer may be provided with one or more coupling members configured to be coupled with a source of motive force, such as a winch, pulley, motor vehicle, or the like. Optionally, a plurality of connectors (e.g., pull lugs) may be provided along the front, back, and/or side(s) of the veneer dryer and configured to be coupled with the source of motive force. The connectors may be arranged in a configuration designed to distribute push/pull forces among desired portions of the veneer dryer.

In some embodiments, the veneer dryer may further include a plurality of movers coupled with a bottom portion of the veneer dryer. The movers may be arranged on the bottom portion at locations that correspond to portions of a track (e.g., a pair of rails). The movers may include a frame and a track engaging portion. The frame may define a dryer engaging portion configured to be coupled with the veneer dryer (e.g., by bolts, welding, or the like). The track engaging portion may be configured to roll or slide along the track (e.g., on an upper surface of a rail). In some embodiments, the track engaging portion may include one or more rollers movably and/or rotatably coupled with the frame. For example, a track engaging portion may be a roller assembly having a plurality of rollers linked by a roller chain. Other examples of track engaging portions may include, but are not limited to, continuous tracks, low-friction surfaces, roller bearings, wheels, and the like. Optionally, some or all of the movers may further include a guide portion configured to limit lateral movement of the movers on portions of the track/rails. For example, guide portions may be rollers, pins, or other suitable structures coupled with the frame, or projecting portions of the frame.

Embodiments of a veneer dryer system may include a track and a veneer dryer movably coupled with the track. The track may include one or more rails that extend between an installation site (e.g., the desired location of the veneer dryer) and a construction site (e.g., the location at which the veneer dryer is built), and the veneer dryer may be constructed on the rails at the construction site. In some embodiments, a plurality of movers may be provided between the track and the veneer dryer. The movers may have a movable portion configured to moveably engage a corresponding one of the rails and a frame configured to engage the veneer dryer. In some embodiments, the movers may be distributed along the rails and the veneer dryer may be constructed on the movers.

In some embodiments, a method for constructing a veneer dryer and/or replacing an existing dryer may include installing a track that extends between a construction site and an installation site, constructing the veneer dryer on the track at the construction site, and moving the veneer dryer along the track to the installation site. The installation site may be a site at which the veneer dryer is to be used, such as within an existing facility. In some embodiments, the installation site may be, or may overlap, the site of the existing dryer. The construction site may be a location at which the construction of the veneer dryer is more convenient or less disruptive to operations of the existing facility, such as an outdoor area and/or another area within the facility. In some embodiments, the method may further include removing the existing dryer from the installation site before moving the veneer dryer to the installation site. Optionally, the veneer dryer may be partially or fully constructed before removing the existing dryer from the installation site (e.g., to allow use of the existing dryer during construction of the new veneer dryer). In some embodiments, the track may be fully constructed before constructing the veneer dryer at the construction site. In other embodiments, a first portion of the track may be constructed at the construction site, the veneer dryer may be partially or fully constructed on the first portion of the track, and the remaining portion(s) of the track may be constructed before, during, or after the construction of the veneer dryer.

In some embodiments, the method may further include coupling the veneer dryer to a foundation (e.g., a concrete pad). Optionally, the veneer dryer may remain coupled with the track at the installation site, allowing the veneer dryer to be moved again as desired. In some embodiments, one or more anchor assemblies may be provided between the foundation and the veneer dryer. The anchor assemblies may be configured to inhibit forward/rearward movement of corresponding portions of the veneer dryer along the track. In some embodiments, the anchor assemblies may be configured to prevent such movement while permitting lateral expansion and contraction of the veneer dryer. Optionally, one or more portions of the rail may be tapered to accommodate lateral movement of the movers on the rail in response to lateral expansion of the veneer dryer. In some embodiments, the method may include fixedly coupling one or more of the movers with a portion of the track (e.g., by welding). Optionally, some or all of the other movers may remain movably coupled with corresponding portions of the track to accommodate axial expansion and contraction of the dryer.

While embodiments are described herein with regard to a veneer dryer 100 by way of explanation, persons with skill in the art will readily recognize that the systems and methods described herein may be used to construct, relocate, and/or replace veneer dryers of various types, dimensions, and configurations, as well as various other constructs (e.g., lumber kilns, processing lines or portions thereof, machinery/enclosures, etc.). Therefore, the substitution of other types of veneer dryers, lumber kilns, processing lines or portion(s) thereof, machines, and/or other constructs in place of the referenced "veneer dryer" in the described systems and methods is specifically contemplated, and such embodiments are disclosed and encompassed by the present description.

Figure 1B:
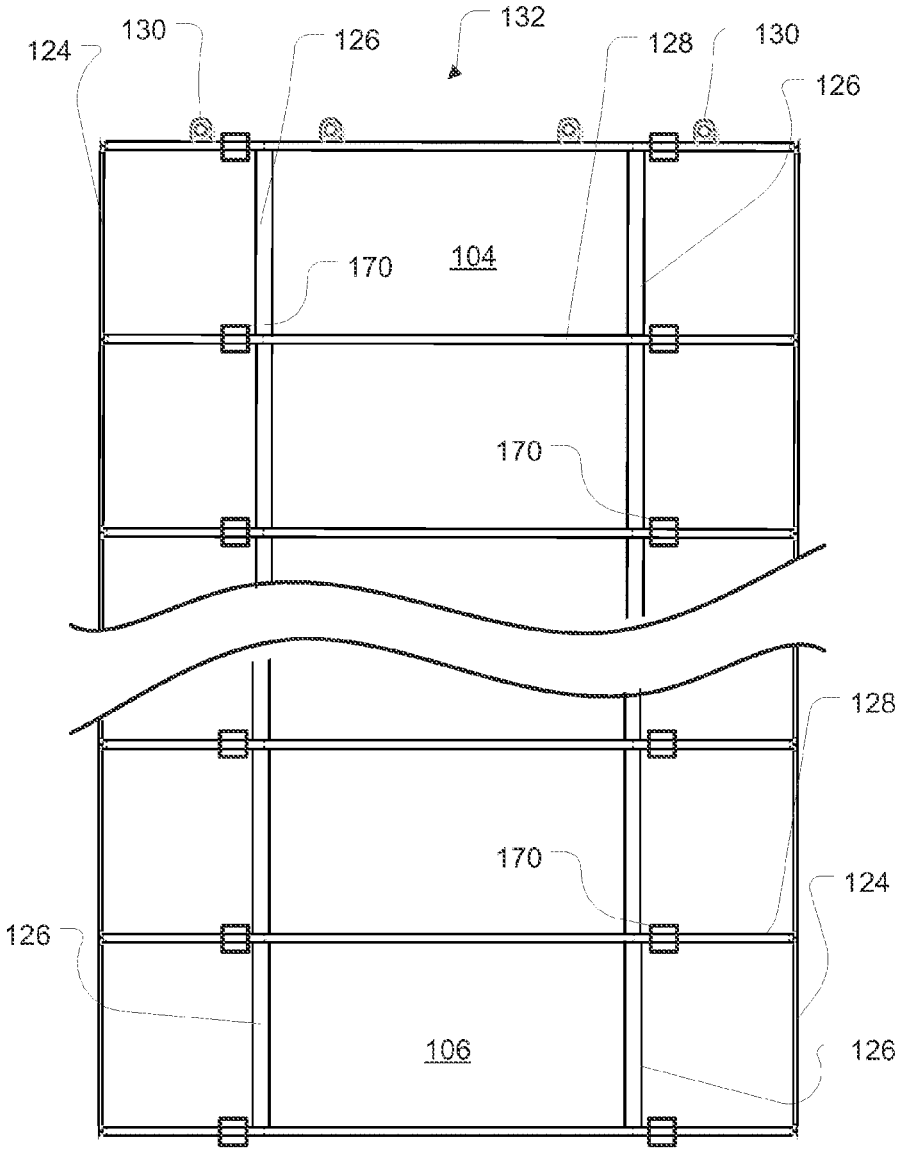

FIGS. 1A-1B illustrate perspective and bottom views of a veneer dryer 100, in accordance with various embodiments. Referring first to FIG. 1A, veneer dryer 100 may include a plurality of consecutive drying sections 104 arranged between an input end and an output end of the veneer dryer. Veneer dryer 100 may further include a heating system configured to heat the drying sections 104 with natural gas, propane, light oil, wood residue, saturated steam, circulated oil, or other heat sources.

Optionally, veneer dryer 100 may include one or more cooling sections 106 arranged between a last one of the drying sections 104 and the output end of the veneer dryer. Collectively, drying sections 104 and cooling sections 106 (if any) form the main body 102 of veneer dryer 100. Thus, the axial length of the main body of veneer dryer 100 is the distance from the proximal wall of the first drying section 104 to the distal wall of the last cooling section 106. In some embodiments, the main body of veneer dryer 100 may have an axial length of 40-80 feet, 60-100 feet, 80-120 feet, 100-140 feet, 120-160 feet, 140-180 feet, 160-200 feet, 180-220 feet, 200-300 feet, 150-180 feet, 160-180 feet, or 168-178 feet.

In some embodiments, veneer dryer 100 may have one or more conventional conveyors/decks (not shown) that extend through the drying sections 104 and cooling sections 106 to convey sheets of material (e.g., veneer) from the input end to the output end of veneer dryer 100. In some embodiments, veneer dryer 100 may be a jet veneer dryer. As is readily understood by those with skill in the art, a "jet veneer dryer" is a type of dryer used to reduce the moisture content of sheet material such as wood veneers, pulp board, plasterboard, fiberboard, perlite board, and the like.

In various embodiments, some or all of the drying sections may be provided with corresponding axial-type fans 108. Optionally, veneer dryer 100 may include pressurized fan shaft seals (not shown) coupled with a fan shaft seal air fan 114, which may help to provide a cleaner local environment. Fans 108 may be arranged to circulate air in a circular path within the drying sections 104, with the circulating air flowing transverse to the path of sheet material movement. In some embodiments, fans 108 may be configured to force air through a heat source (not shown) and into jet veneer dryer nozzles (not shown) positioned above and below the sheet material in the drying section, as is conventional. In some embodiments, some or all of drying sections 104 may share a common fan inlet plenum (not shown) through which the air is returned to fans 108.

An exhaust 110 may be coupled with one or more of the drying sections 104. In some embodiments, exhaust 110 may be a single point exhaust, and gases from drying sections 104 may be exhausted primarily or solely through exhaust 110. Optionally, exhaust 110 may be coupled to a first one of the drying sections 104 at the upstream end of veneer dryer 100.

One or more of the cooling sections 106 may be provided with an intake 116 and an exhaust 118. Intake 116 may be configured to draw ambient air into impinging contact with the sheet material traveling through the cooling section, and exhaust 118 may be configured to exhaust the air after the air has circulated around the sheets of material. The number and dimensions of drying sections 104 and cooling section(s) 106 may vary among embodiments. While the illustrated embodiment includes eighteen drying sections 104, other embodiments may have 8-12 drying sections, 12-18 drying sections, or 18-24 drying sections. Likewise, while the illustrated embodiment includes three cooling sections 106, other embodiments may include one, two, four, or more than four cooling sections.

In some embodiments, veneer dryer 100 may include an infeed section 112 operatively coupled with a first one of the drying sections 104. Infeed section 112 may be a conventional veneer dryer infeed with one or more levels/decks configured to feed sheets of material into the veneer dryer. Veneer dryer 100 may further include a conventional conveyor system (not shown) with pinch rollers/conveyors configured to transport sheets of material from infeed section 112 through the drying sections 104 and cooling sections 106 to an output end of the veneer dryer. Optionally, veneer dryer 100 may include an outfeed section 120, which may be positioned at the output end of the veneer dryer. In some embodiments, outfeed section 120 may include a drive unit configured to drive the conveyor system (not shown). In various embodiments, veneer dryer 100 may include a chain tightener 122 at the input end to adjust tension in the deck drive chains.

In some embodiments, veneer dryer 100 may be provided with a control system (not shown) configured to automatically control various operations of drying sections 104 and/or cooling sections 106 (e.g., pressure, exhaust volume, exhaust rate, veneer temperature).

In various embodiments, the veneer dryer may include a plurality of movers coupled to a bottom portion of the veneer dryer. The movers may be configured to roll/slide along a support surface (e.g., rail, track, ground/floor, foundation), allowing the veneer dryer to be pulled/pushed from one site/location to another. Therefore, in various embodiments, the veneer dryer may have structural reinforcements not present in conventional veneer dryers. For example, the veneer dryer may have supports that are arranged/configured to reduce or minimize damage such as distortion or physical separation of panels, beams, and other components as force is applied to veneer dryer 100 (e.g., pushing/pulling forces, gravitational force). Optionally, the veneer dryer may have one or more design features configured to enhance resistance to distortion or physical separation of components in response to the application of force. For example, the veneer dryer may include larger/additional fasteners (e.g., bolts, welds, rivets, etc.), additional panels, beams, and/or other components, larger/additional areas of overlap between components (e.g., panels, beams, supports), and/or more supports that connect multiple components than conventional veneer dryers.

FIG. 1B illustrates a bottom view of a veneer dryer 100, in accordance with various embodiments. In various embodiments, a bottom portion of veneer dryer 100 may include transverse supports 128. In some embodiments, one or more transverse supports 128 may be positioned between two heating/cooling sections. In other embodiments, transverse supports 128 may be spaced apart at intervals of 1-40 feet, 2-30 feet, 4-20 feet, or 5-10 feet.

In some embodiments, transverse supports 128 may be connected by one or more additional supports. For example, the first ends of transverse supports 128 may be connected by a longitudinal support 124, and the opposite second ends of transverse supports 128 may be connected by another longitudinal support 124. Optionally, one or more longitudinal supports 126 may be coupled with two or more transverse supports 128 between the first and second ends of transverse supports 128 (e.g., proximal to the rails). In some embodiments, transverse supports 128, longitudinal supports 124, and/or longitudinal supports 126 may be provided along the length of veneer dryer 100 and/or body 102. In other embodiments, transverse/longitudinal supports may be provided along the portion of the veneer dryer that will bear a push/pull force (e.g., a leading end, a side, and/or a lagging end of the veneer dryer). In other embodiments, the veneer dryer may have a bottom portion that includes one or more supports (e.g., beams, braces, plates) arranged in any other suitable manner.

In some embodiments, veneer dryer 100 may include one or more connectors 130. As illustrated in FIG. 1B, connectors 130 may be pull lugs positioned along an exterior surface of an end-most transverse support 128. In other embodiments, connectors 130 may be rings, hooks, apertures, or other features disposed along an exterior surface of the veneer dryer (e.g., a support, a wall) and configured to be coupled with one or more cables of a winch, pulley, motor vehicle, and/or other source of motive force. Optionally, a plurality of connectors 130 may be provided along the front, back, and/or side(s) of the veneer dryer. In various embodiments, connectors 130 may be arranged in a configuration designed to distribute push/pull forces among desired portions of the veneer dryer. Some embodiments may lack connectors 130.

A plurality of movers 170 may be coupled with transverse supports 128, longitudinal supports 124/126, and/or other parts of the bottom portion of the veneer dryer. For example, as illustrated in FIG. 1B, movers 170 may be coupled with transverse supports 128. Alternatively, movers 170 may be coupled with one or more longitudinal supports 124/126. While the number, size, length, and orientation of transverse/longitudinal supports may vary among embodiments, movers 170 will typically be positioned between the bottom portion of the veneer dryer and an underlying surface, such as a rail or track. In some embodiments, the movers may be distributed along the rails and/or bottom of the veneer dryer at predetermined intervals, such as at intervals of 5-10 feet, 5-15 feet, 10-20 feet, 15-30 feet, or 20-40 feet.

Figure 1C:
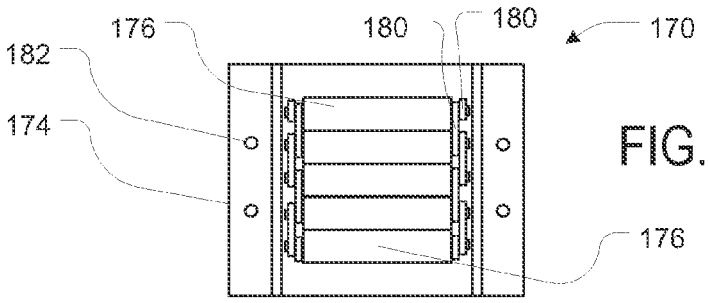
FIGS. 1C-1H illustrate examples of movers, in accordance with various embodiments.

Movers 170 may be configured to roll/slide along the underlying surface. In some embodiments, movers 170 may have one or more rollers. In some embodiments, movers 170 may be load moving skates. FIG. 1C illustrates a bottom view of a mover, in accordance with various embodiments. As illustrated, a mover 170 may include rollers 176 coupled with a frame 174. Optionally, frame 174 may have one or more coupling features 182, such as bolts, other fasteners, and/or threaded openings for bolts or other fasteners.

Figure 1D:
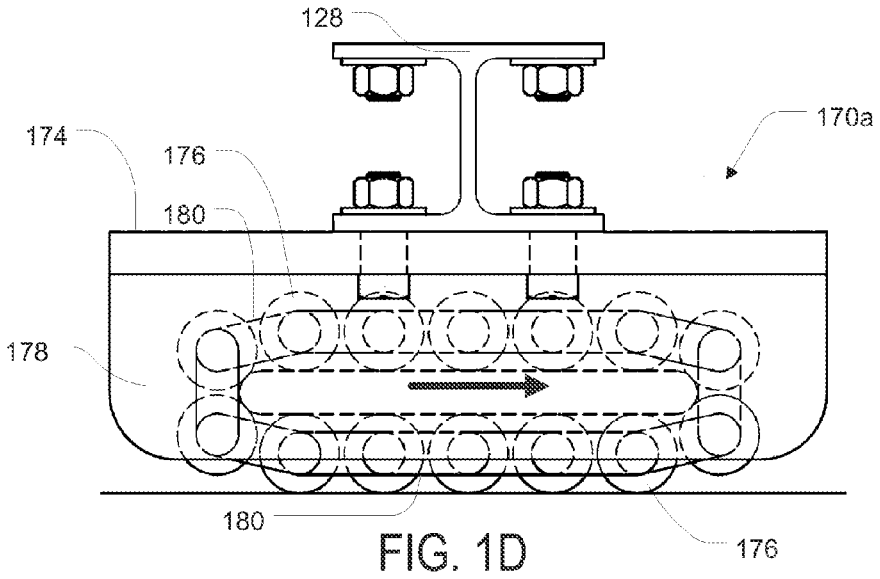
Figure 1E:
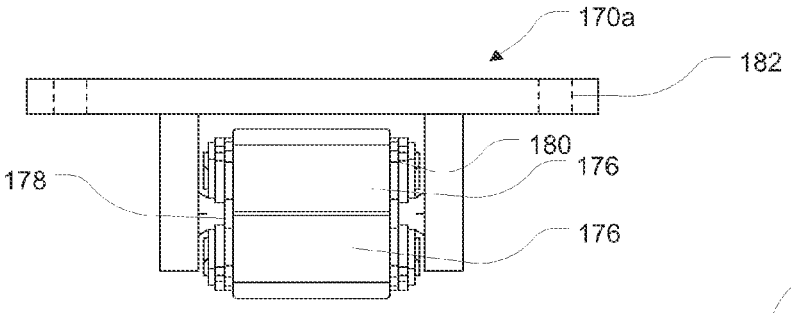
Figure 1F:
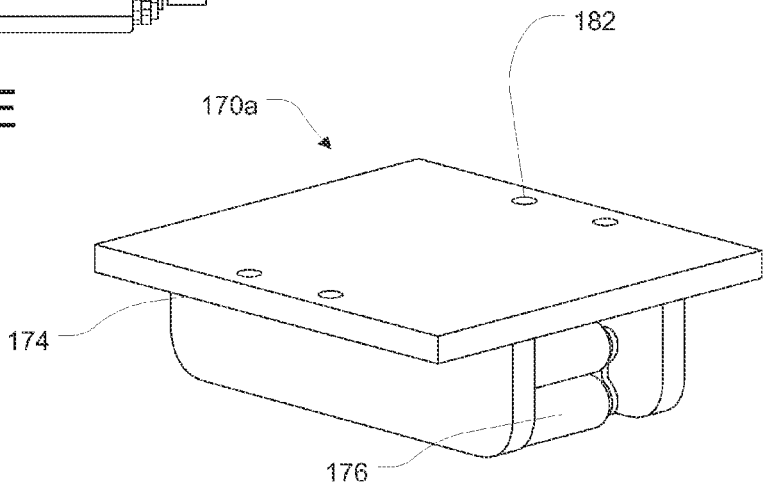

Optionally, rollers 176 may be coupled by links 180 to form an endless loop. FIGS. 1D, 1E, and 1F illustrate side, front, and perspective views, respectively, of a mover 170*a*, in accordance with various embodiments. Mover 170*a* may have a frame 174 with a load bearing platform 178. Rollers 176 may be coupled together by links 180 to form an endless loop. The endless loop may be rotatable around the load bearing platform 178 in a first direction (arrow). As shown in FIG. 1D, the frame 174 may be coupled with a bottom portion of the veneer dryer, such as a transverse support 128.

Figure 1G:
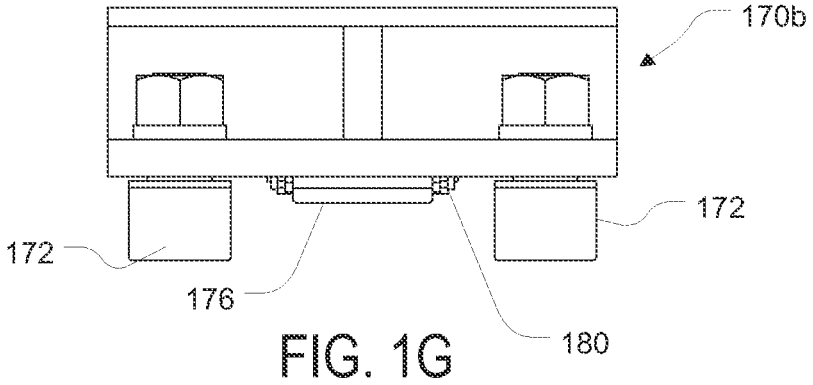
Figure 1H:
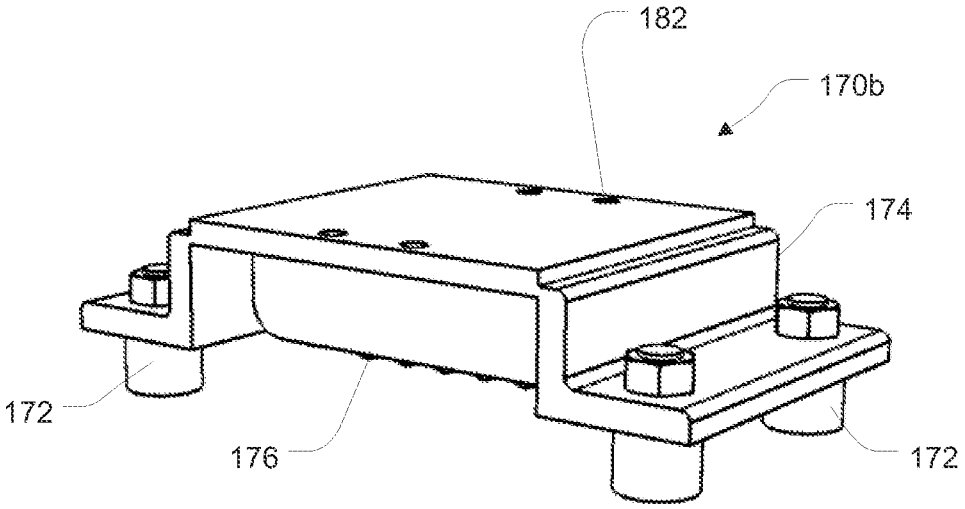

In some embodiments, the veneer dryer and/or track may be provided with two groups of movers having different configurations. For example, one group of movers may have one or more guide features configured to restrict lateral movement of the mover on the track/rail. FIGS. 1G and 1H illustrate front and perspective views, respectively, of a mover with guides in accordance with various embodiments. As illustrated, a mover 170*b* may have rollers 176, a frame 174, coupling features 182, and/or other features substantially as described above with respect to movers 170*a*. In addition, movers 170*b* may include one or more guides 172. In some embodiments, guides 172 may be coupled with frame 174. Guides 272 may be configured to engage a side surface of the corresponding rail. In various embodiments, guides 172 may be rolls, pins, and/or protruding portions of frame 174. For example, guides 172 may be rolls that are rotatably coupled with frame 172. Optionally, guides 172 may be arranged in pairs and spaced apart by a gap. The size of the gap may be selected based on the width of an underlying rail and a desired degree of lateral mobility of mover 170*b* on the underlying rail.

Figure 2A:
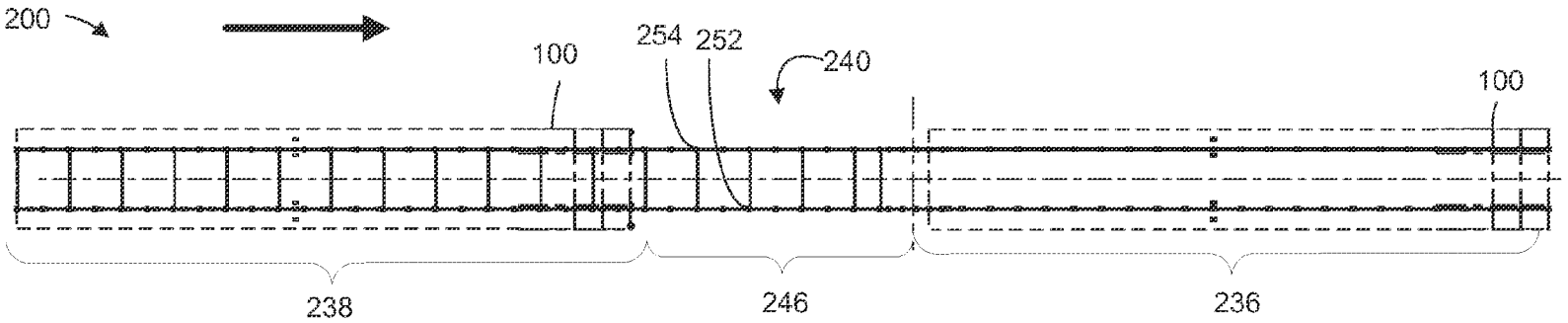
FIGS. 2A-2C illustrate top and side elevational views, respectively, of a veneer dryer system and details thereof, in accordance with various embodiments.
Figure 2B:
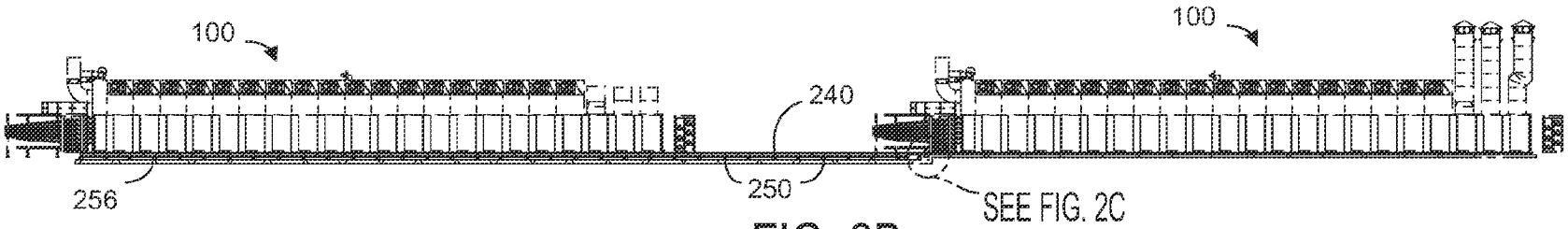

Embodiments of a veneer dryer system may include a veneer dryer (e.g., veneer dryer 100) and a track. The veneer dryer may be partially or fully constructed on the track and subsequently pushed/pulled along the track to a desired location at the other end of the track (e.g., the installation site). In some embodiments, the veneer dryer may be connected to a winch, pulley, motor vehicle, or other source of motive force operable to push/pull the veneer dryer along the track in the direction of travel. FIGS. 2A-2B illustrate top and side elevational views, respectively, of a veneer dryer system 200 that includes a veneer dryer 100 movably coupled with a track 240. In some embodiments, as shown for example in FIGS. 2A-2B, the veneer dryer may be constructed such that the output end of the veneer dryer is downstream of the input end in the direction of travel (see FIG. 2A, arrow). Alternatively, the veneer dryer may be constructed in the opposite orientation, such that the input end of the veneer dryer is downstream of the output end. In other embodiments, the veneer dryer may be constructed on the track in a transverse orientation, such that the long axis of the veneer dryer extends generally perpendicular to the tracks (see e.g., FIG. 10).

Track 240 may have a first end disposed at an installation site 236 and a second end disposed at a construction site 238. Installation site 236 may be the desired final location of veneer dryer 100. In some embodiments, installation site 236 may be a location within a building, such as a plywood mill or other wood processing facility. Optionally, installation site 236 may be the location of a pre-existing veneer dryer. Construction site 238 may be an indoor or outdoor construction location (i.e., where veneer dryer 100 is to be fully or partially assembled prior to the relocation of veneer dryer 100 to installation site 236. Optionally, construction site 238 may be a location within the same or different building/enclosure as installation site 236. Alternatively, construction site 238 may be an outdoor location or other location. In some embodiments, installation site 236 and/or construction site 238 may have substantially the same dimensions (e.g., length/width) as the corresponding dimensions of veneer dryer 100 and/or the body of veneer dryer 100.

In some embodiments, track 240 may also have a middle portion 246 between the opposite first and second ends. In various embodiments, middle portion 246 of track 240 may have a length of up to 50 feet, 50-100 feet, 100-200 feet, 200-300 feet, 300-500 feet, or more than 500 feet. Other embodiments may lack a middle portion 246.

As illustrated in FIGS. 2A-2B, track 240 may extend generally parallel to the long axis of veneer dryer 100. In other embodiments, track 240 may be oriented transverse to the long axis of the veneer dryer (see e.g., FIG. 10).

In some embodiments, track 240 may include a first rail 252 and a second rail 254 that is generally parallel to first rail 252. In other embodiments, track 240 may include three, four, or more than four rails. A plurality of rail sections may be joined together to form one or both of first and second rails 252/254. In various embodiments, rail sections may be joined together by conventional means, such as by plates/bolts.

Figure 2C:
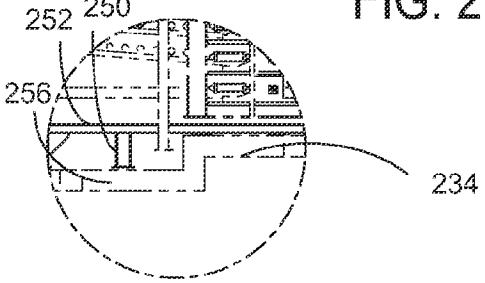

Track 240 may be assembled on an underlying support surface 256. Support surface 256 may be a floor/ground surface that is continuous (e.g., a concrete surface) or discontinuous (e.g., floor/ground surface within a lumber processing facility and a floor/ground surface outside of the lumber processing facility). In some embodiments, one or more portions of support surface 256 may be elevated relative to other portions of support surface 256. For example, as shown in FIGS. 2B-2C, support surface 256 may include a foundation at installation site 236. The foundation may be a new or pre-existing veneer dryer foundation, a raised concrete pad, or other type of raised support. Thus, in some embodiments, support surface 256 may have a greater height at installation site 236 than at construction site 238. Optionally, support surface 256 may include one or more anchor pedestals at installation site 236 and/or one or more corresponding pedestals at construction site 238, as described further below.

Figure 3A:
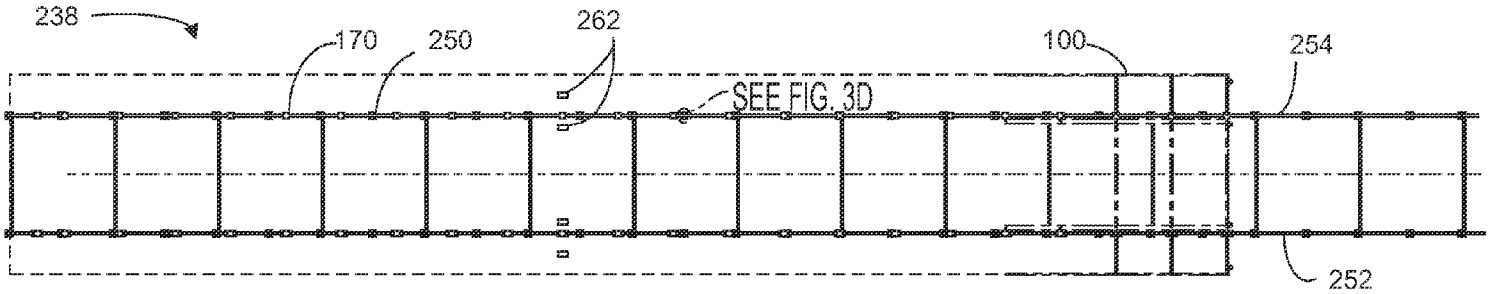
FIGS. 3A-3B illustrate top and side elevational views, respectively, of a construction zone portion of a track system, in accordance with various embodiments.
Figure 3B:
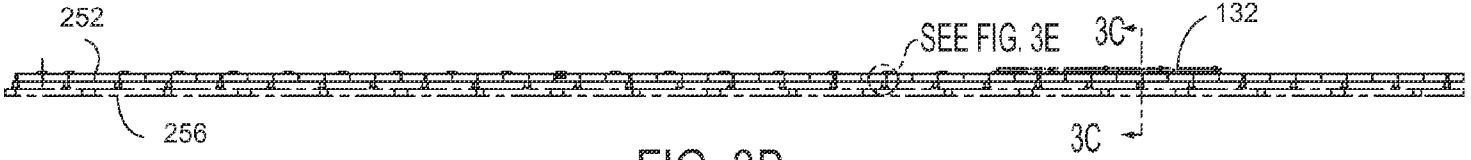
Figure 3C:
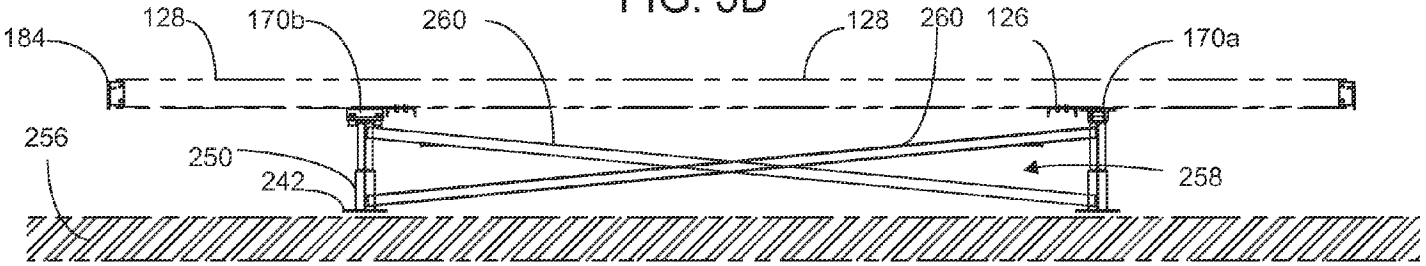
FIGS. 3C-3E illustrate further details of the track system of FIGS. 3A-3B, in accordance with various embodiments.
Figure 3D:
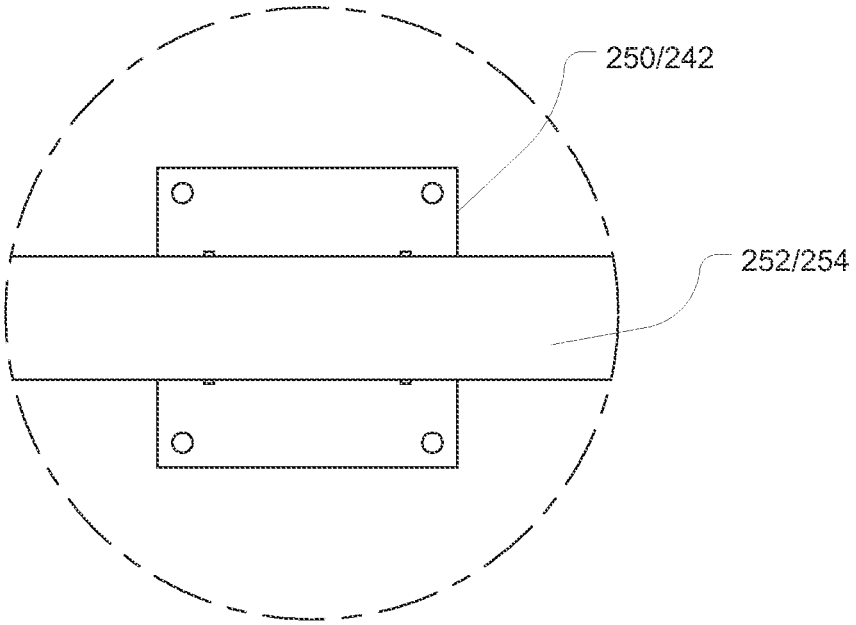
Figure 3E:
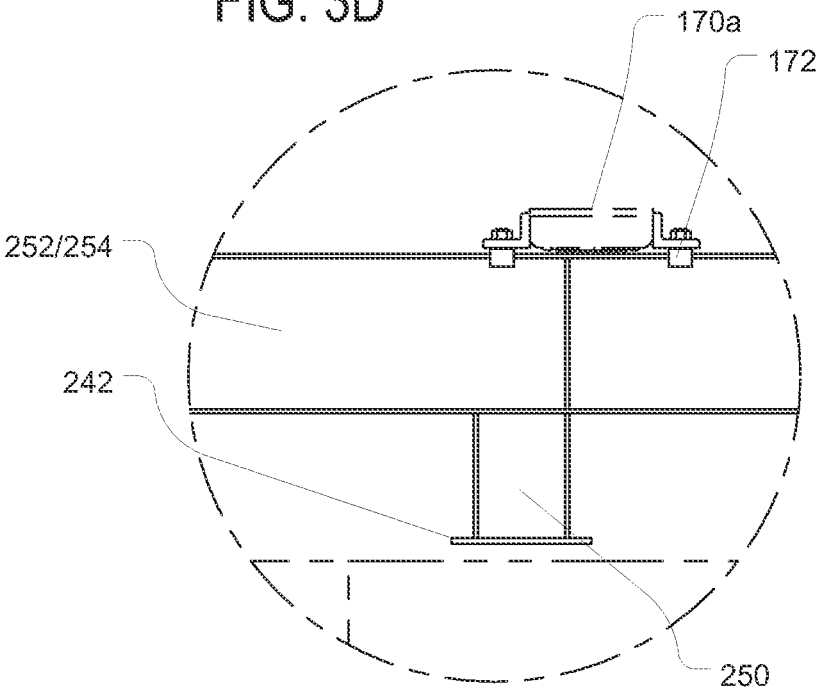

In some embodiments, veneer dryer 100 may be constructed on track 240 at a construction location (e.g., construction site 238) and moved along track 240 to a desired location (e.g., installation site 236). FIGS. 3A-3B illustrate top and side elevational views, respectively, of a construction zone portion of a track system, and FIGS. 3C-3E illustrate additional details of the construction zone portion of the track system of FIGS. 3A-3B, all in accordance with various embodiments. Views of a destination zone portion of are illustrated in FIGS. 4A-4G and the accompanying description below.

Referring first to FIGS. 3A-3B, the veneer dryer (or other construct) may be constructed at construction site 238 on rails 252/254. In some embodiments, when substantially completed (e.g., at the time the veneer dryer or other construct is moved from construction site 238 to installation site 236), the veneer dryer or other construct may have a weight of 300,000-600,000 lbs, 500,000-750,000 lbs, 700,000-900,000 lbs, 800,000-1,000,000 lips, 800,000-1,200,000 lbs, 900,000-1,100,000 lbs, 1,000,000-1,500,000 lbs, or 1,500,000-2,000,000 lbs. Therefore, the number, sizes, and types of various structural supports may vary among embodiments.

In various embodiments, one or more pedestals 262 may be provided at construction site 238 (e.g., on support surface 256). Pedestals 262 may be constructed from concrete, metal, and/or other materials and positioned between the rails and/or along one or both sides of track 240. In some embodiments, pedestals 262 may be configured to engage or support a portion of veneer dryer 100 without a mover 170 between the pedestal and the veneer dryer. Pedestals 262 may be positioned to engage and/or support a particular section of veneer dryer 100. Optionally, pedestals 262 at construction site 238 and corresponding anchor pedestals at installation site 236 may be positioned to engage substantially the same section of the veneer dryer (e.g., a middle section/portion). For example, for a veneer dryer with eighteen heating sections 104, pedestals 262 may be positioned on one or both sides of rails 252/254 at a location that coincides with the ninth and/or tenth heating section 104. Alternatively, pedestals 262 and may be positioned to support or engage a different portion of the veneer dryer (e.g., another heating section 104, a transverse support 230, a middle portion of body 102, a particular heating section 104 or cooling section 106) than the anchor pedestals at installation site 236. Some embodiments may lack pedestals 262.

In various embodiments, one or more portions of first rail 252 and/or second rail 254 may be mounted on legs 250. Legs 250 may be provided to adjust rail elevation and/or for structural support. For example, first rail 252 and second rail 254 may be mounted on legs 250 at construction site 238 and along the middle portion 246 of track 240 to accommodate an elevational change between construction site 238 and installation site 236 (e.g., due to a raised foundation at installation site 236). Alternatively, the difference in elevation may be reduced by raising a portion of underlying support surface 256 (e.g., by adding a layer of concrete) or lowering the elevated portion of underlying support surface 256 (e.g., by removing material to the desired depth) before track 240 is assembled. In some embodiments, rails 252/254 may be formed by joining rail sections (e.g., steel beams) together. Optionally, rail sections of different heights/dimensions may be used to reduce differences in elevation along support surface 256. In various embodiments, legs 250 may be spaced apart at predetermined distances along the corresponding portions of first rail 252 and/or second rail 254.

As shown for example in FIG. 3C, track 240 may be provided with one or more supports that extend between first and second rails 252 and 254. In various embodiments, supports 258 may be coupled with first rail 252, second rail 254, and/or legs 250 to provide structural reinforcement. For example, supports 258 may be cross-braces formed by coupling (e.g., welding or bolting) opposite ends of a support member 260 to first rail 252 and a leg 250 of second rail 254, respectively, and coupling opposite ends of another support member 260 to second rail 252 and a leg 250 of first rail 254, respectively. Optionally, the cross-brace may be reinforced by welding, bolting, or otherwise fastening the support members 260 together where the support members 260 cross one another.

In some embodiments, supports 258 may be formed at intervals along one or more portions of track 240. In a particular embodiment, supports 258 may be provided at intervals of 5-20 feet, 15-30 feet, or 20-50 feet along track 240 or portion(s) thereof, such as middle portion 246 and/or second end 244. Supports 258 may be provided at intervals corresponding to legs 250 (e.g., a support 258 at each leg 250, at each second leg 250, or at other multiples of legs 250). In a particular embodiment, supports 258 may be provided along portions of track 240 that are mounted on legs 250 or are otherwise elevated above underlying support 256. Other embodiments may have supports 258 that include only one support member 260 or more than two support members 260. Support members 260 may be elongate bars, beams, or other suitable structures. Some embodiments may lack supports 258 and/or support members 260.

Optionally, legs 250 may have one or more members 242 configured to provide support/stability (e.g., a pad or pedestal; FIG. 3D) and/or to adjust the vertical height of legs 250. In some embodiments, legs 250 and/or members 242 may include leveling nuts or other mechanisms for adjusting the vertical height of legs 250.

Referring again to FIG. 3C, movers (e.g., movers 170/170*a*/170*b*) may be positioned along the rails 252/254, and a bottom portion of the veneer dryer (e.g., lateral supports 128) may be coupled with the movers. Lateral supports 128 may be coupled with other portions of the veneer dryer, such as longitudinal supports 124, by connectors 184 (e.g., steel plates/brackets). Thus, the veneer dryer may be supported on rails 152/154 by movers 170. Again, some movers may include one or more guides 272 (see also FIG. 3E). In other embodiments, all of the movers may have guides 272 or other guide features. In still other embodiments, all of the movers may lack guides 272 or other guide features.

The number, configuration, and type of movers 170, track 240, and other components may vary among embodiments. For example, in some embodiments movers 170 may have rollers that are rotatably coupled with the frame in a fixed arrangement (e.g., in a row). In other embodiments, movers 170 may be rollers without frames. In still other embodiments, track 240 or some portion thereof may be recessed in the underlying support surface, such as one or more grooves or tracks formed in a concrete pad/foundation. In still other embodiments, track 240 may be defined along the underlying support surface by paired rails or tracks that serve as guides, and the movers 170 may be configured to roll or slide along the underlying support surface between the rails/tracks.

Figure 4A:
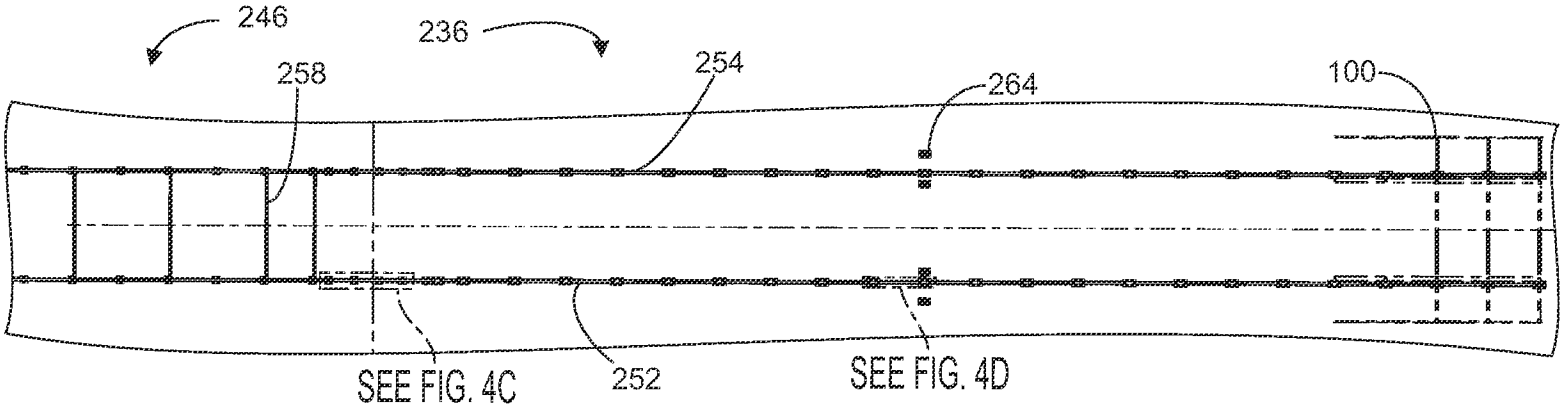
FIGS. 4A-4B illustrate top and side elevational views, respectively, of a destination zone portion of a track system, in accordance with various embodiments.
Figure 4B:
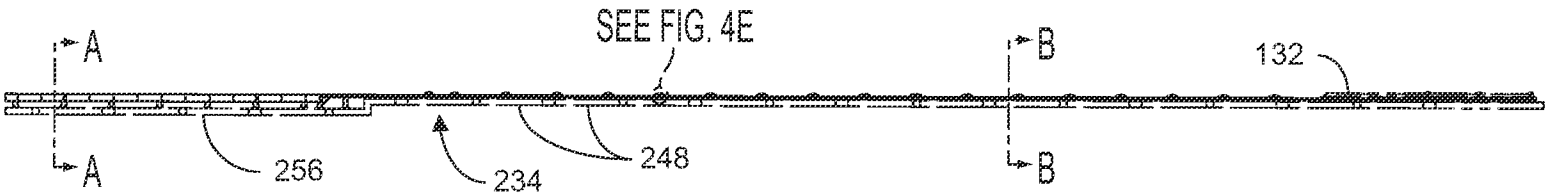

FIGS. 4A-4B illustrate top and side elevational views, respectively, of a destination zone portion of a track system, and FIGS. 4C-4G illustrate additional details of the destination zone portion of the track system of FIGS. 4A-4B, all in accordance with various embodiments.

As discussed above, the veneer dryer (or other construct) may be partially or fully constructed at construction site 238 and subsequently pushed/pulled on track 240 to a desired location (e.g., installation site 236).

Referring now to FIGS. 4A-4B, one or more anchor pedestals 264 may be provided at installation site 236 (e.g., on support surface 256 and/or a raised foundation). Anchor pedestals 264 may be constructed from concrete, metal, and/or other materials and positioned between the rails and/or along one or both sides of track 240. In some embodiments, anchor pedestals 264 may be configured to engage or support a portion of veneer dryer 100 without a mover 170 between the anchor pedestal and the veneer dryer. Anchor pedestals 264 may be positioned to engage or support a particular section of veneer dryer 100. For example, anchor pedestals 264 may be positioned to engage a middle portion of the veneer dryer. Optionally, anchor pedestals 264 may be configured to accommodate lateral expansion of the veneer dryer while restricting longitudinal movement of the veneer dryer (e.g., along the long axis of the veneer dryer). Some embodiments may lack anchor pedestals 264.

Figure 4C:
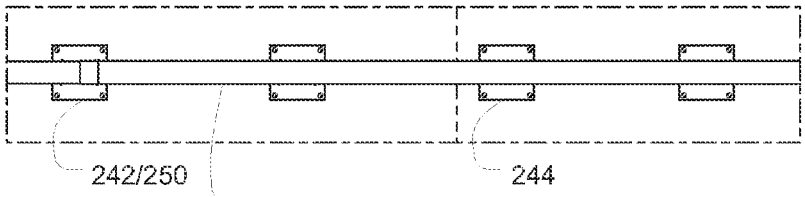
FIGS. 4C-4G illustrate further details of the track system of FIGS. 4A-4B, in accordance with various embodiments.
Figure 4D:
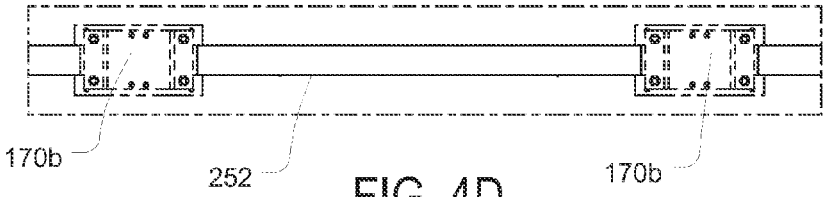
Figure 4E:
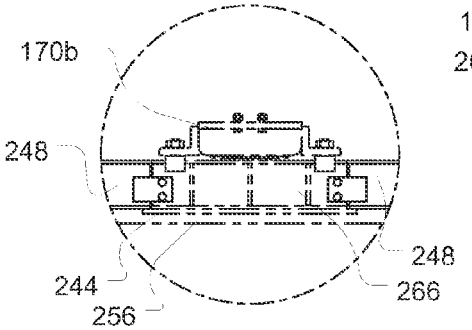
Figure 4F:
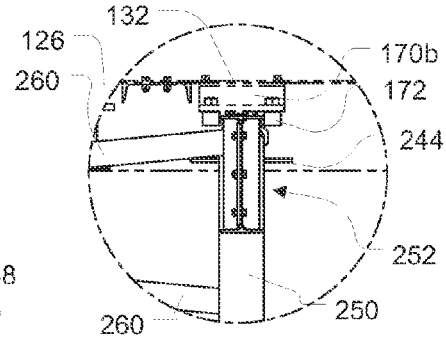
Figure 4G:
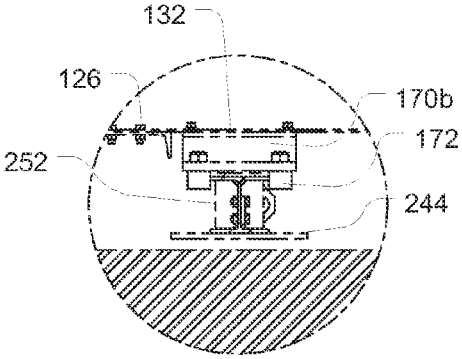

FIG. 4B illustrates a side view of the track portion of FIG. 4A, and FIGS. 4F and 4G illustrate views along sections A-A and B-B of FIG. 4B, respectively. As shown for example in FIG. 4G, rails 252/254 may be positioned on support surface 256 and/or on foundation 234 at installation site 236. Again, portions of rails 252/254 upstream of installation site 236 may be elevated (e.g., on legs 250) to match the height of the support surface/foundation at installation site 236 (FIG. 4F).

In some embodiments, at installation site 236 the rails 252/254 may include a plurality of rail sections joined end-to-end. Some or all of the rail sections may be positioned on supports, such as pads 244, which may in turn be coupled with support surface 256 with bolts or by other conventional means (FIG. 4C). Optionally, the upper portion of one or more of first and second rails 252/254 may be narrowed or tapered in one or more locations. For example, one or more of rails 252/254 may be tapered at locations that coincide with desired locations of one or more movers 170 at installation site 236 (see e.g., FIG. 4D). As another example, one or more of rails 252/254 may be tapered at a transition between rail sections (e.g., between middle portion 236 of the track and installation site 236; FIG. 4C). Narrowing/tapering one or both rails may provide the movers (e.g., movers 170*b*) greater lateral mobility to accommodate lateral expansion of the veneer dryer during operation and/or aid in moving the veneer dryer over the transitions between rail sections.

In some embodiments, rail sections forming this and/or other portions of first and second rails 252/254 may be permanently joined together. In other embodiments, first and second rails 252/254 may include a combination of permanent and temporary rail sections. For example, as shown in FIG. 4E, temporary rail sections 248 may be removably coupled with permanent rail sections 266 using bolts, welds, or other conventional fasteners. Optionally, rail sections 266 may be positioned such that they engage movers 170 when veneer dryer 100 is in the desired position at installation site 236. Once veneer dryer 100 is in the desired position, temporary rail sections 248 may be removed or left in place as desired. In some embodiments, permanent rail sections 266 may be positioned on pads 244. Pads 244 may be coupled with support surface 256 with bolts or other conventional fasteners. Optionally, shims (not shown) may be positioned below rail sections 248/266 where necessary in order to reduce variations in rail height.

Figure 5:
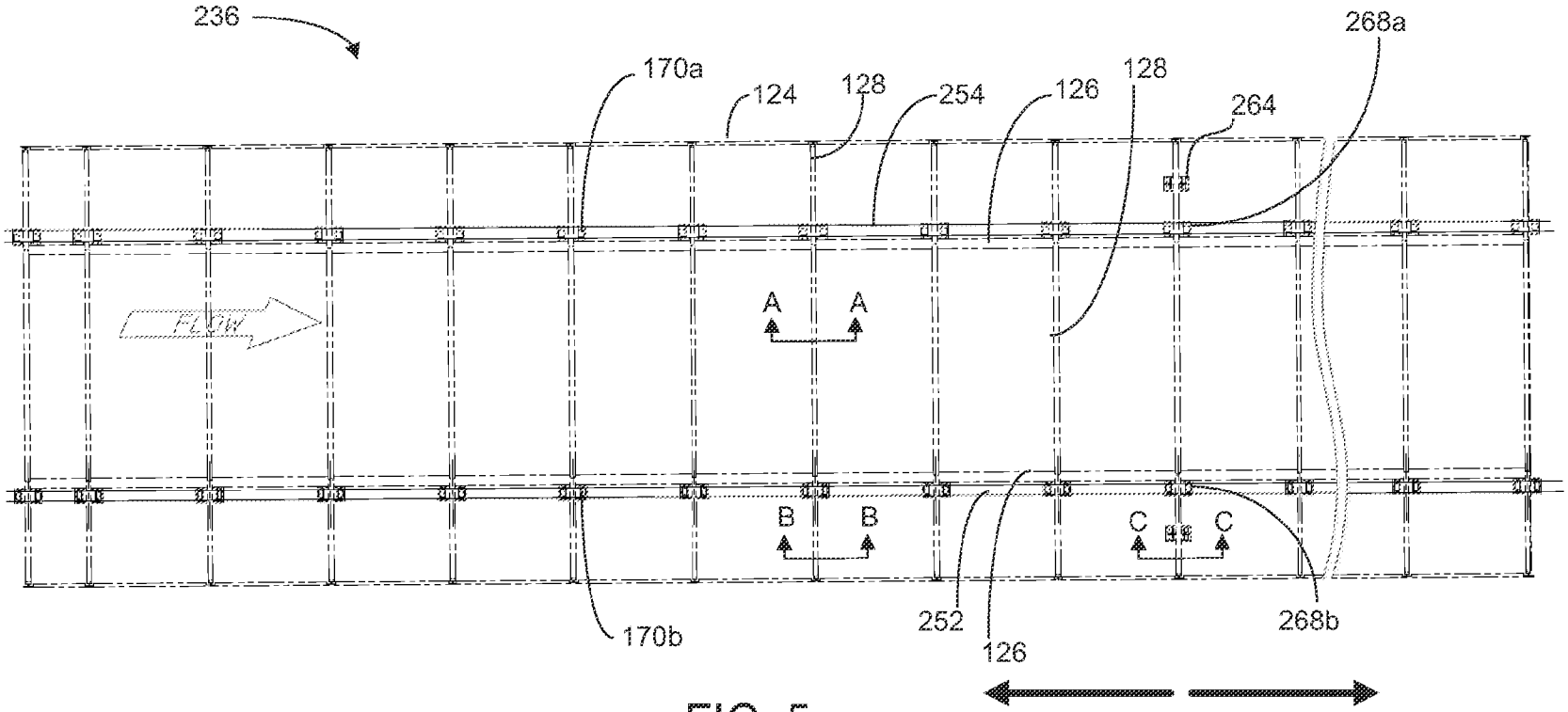
FIG. 5 illustrates a schematic plan view of a veneer dryer coupled with a destination zone of a track system, in accordance with various embodiments.

FIG. 5 illustrates a schematic view of a lower portion of a veneer dryer coupled with the destination zone portion of a track system, in accordance with various embodiments. Once the veneer dryer has been moved to the desired location (e.g., at installation site 236), the movers (e.g., movers 170/170*a*/170*b*) may be positioned on corresponding rail sections of the track, and the veneer dryer may remain coupled with the movers. For example, movers 170*a* may be disposed on rail 254 and coupled with a first end of lateral supports 128, and movers 170*b* may be disposed on rail 252 and coupled with an opposite end of lateral supports 128. Other embodiments may have different configurations/combinations of movers, and/or the movers may be coupled with other portions of the veneer dryer.

At installation site 236, the veneer dryer may be coupled with one or more of track 240 (FIGS. 6A-6C and 7A-7C), foundation 234, anchor pedestal(s) 264 (FIGS. 8A-8C), and/or a portion of underlying support surface 256. The veneer dryer may also be coupled with a power/electricity source, a fuel source, a sensor, a computer system, and/or various other resources used for operation of the veneer dryer at installation site 236.

The movers may remain in position between the track and the veneer dryer to accommodate axial expansion of the veneer dryer during operation. In some embodiments, anchor pedestal(s) 264 may be coupled with the bottom portion of the veneer dryer. Optionally, anchor pedestal(s) 264 may be coupled with a lateral support 128 located approximately halfway between the opposite ends of the veneer dryer and/or main body of the veneer dryer. Anchor pedestal(s) 264 may be configured to restrict axial/longitudinal movement of the corresponding portion of the veneer dryer along the track. As a result, the axial expansion may occur in opposite directions from the anchor pedestal(s) 264 toward the ends of the veneer dryer (see arrows, FIG. 5C). Movers 170 located upstream and downstream of the anchor pedestal(s) 264 may be configured to slide or roll along the corresponding rails or rail sections toward the opposite ends of the veneer dryer in response to the axial expansion/ contraction of the veneer dryer. Optionally, one or more movers 170 may be positioned in lateral alignment with anchor pedestal(s) 264 (e.g., coupled with the same lateral support 128) and may be rigidly coupled with the corresponding rail or rail section by welding or other conventional means.

In various embodiments, anchor pedestal(s) 264 may be configured to allow lateral movement of the corresponding portion of the veneer dryer while restricting longitudinal movement of that portion of the veneer dryer on the track/rails. This may accommodate lateral expansion of the veneer dryer. In some embodiments, a corresponding portion of one or more of the rails or rail sections may be tapered or narrowed to accommodate lateral expansion of the veneer dryer. As illustrated in FIG. 5, one mover may be coupled with rail 252 at position 268*a*, and another mover may be disposed coupled with rail 254 at position 268*b*, such that both of the movers are in lateral alignment with anchor pedestal(s) 264. In some examples, the two movers and the anchor pedestal(s) 264 may be coupled with the same lateral support 128. The mover at one of the positions 268*a*/268*b* may be welded or otherwise rigidly coupled with the corresponding rail, and the other mover may be left movably coupled with the other rail. This configuration may allow lateral expansion of the veneer dryer to proceed in opposite directions from the mover that is rigidly coupled with the rail toward the opposite sides of the veneer dryer. Therefore, in some embodiments, a first mover may be rigidly coupled with one of the rails to define a fixed position (e.g., at position 268*a* or 268*b*), and both axial and lateral expansion of the veneer dryer may proceed outwardly from that fixed position.

Figure 6A:
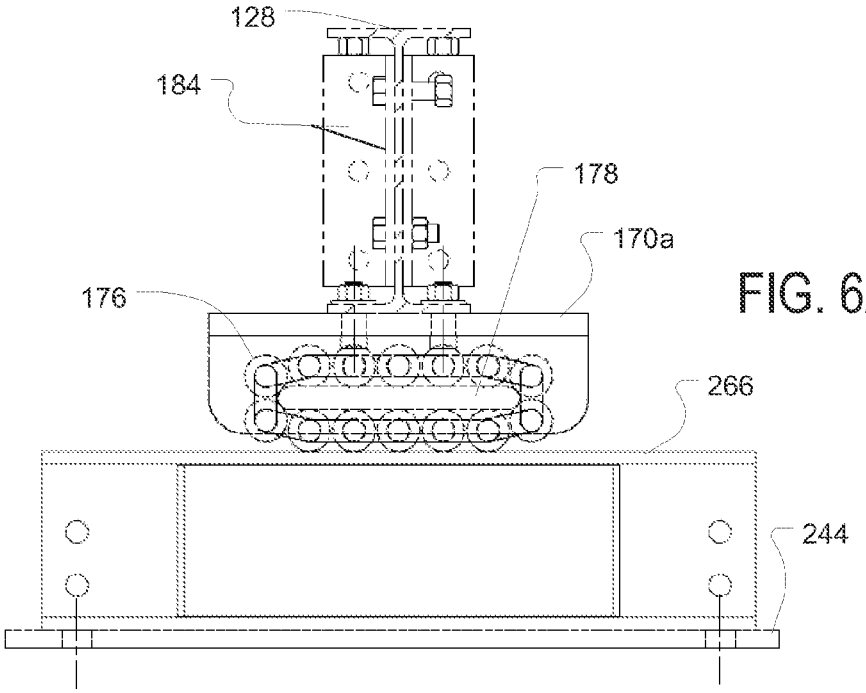
FIGS. 6A-6C illustrate a sectional view of a track system taken along lines A-A of FIG. 5 and corresponding front and top views, respectively, in accordance with various embodiments.
Figure 6B:
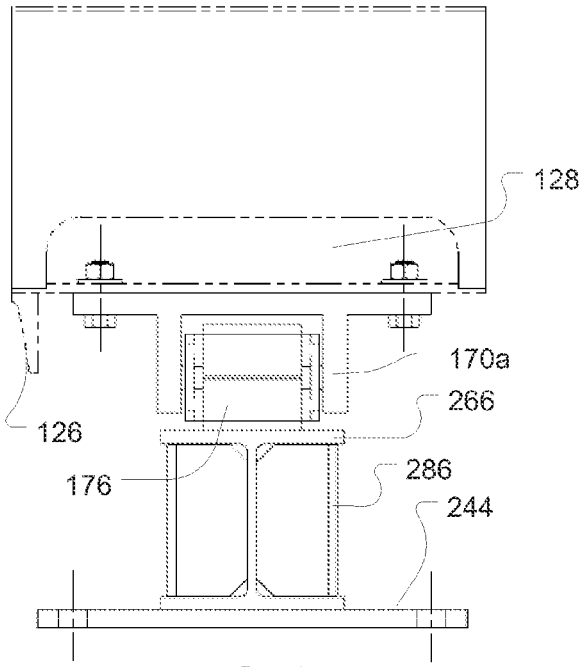
Figure 6C:
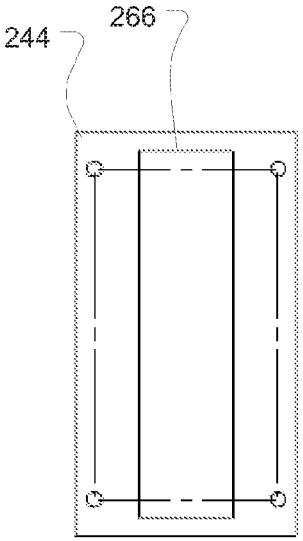
Figure 7A:
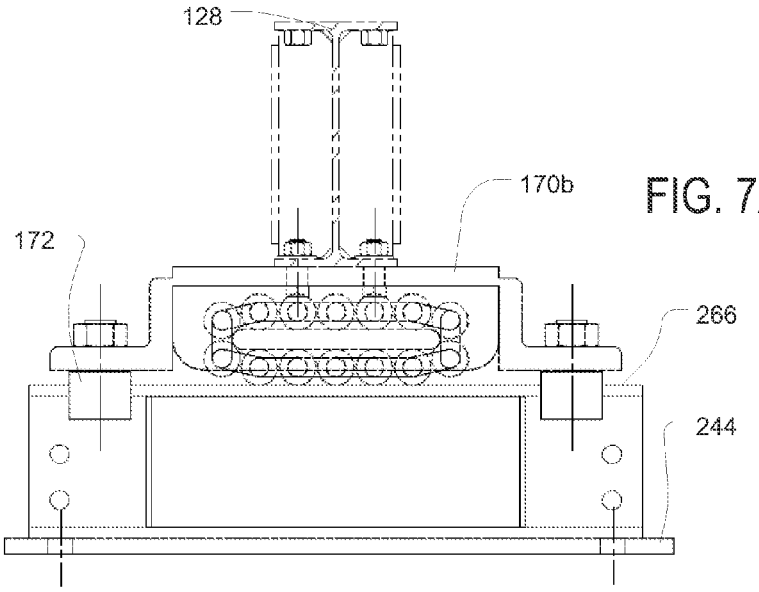
FIGS. 7A-7C illustrate a sectional view of a track system taken along lines B-B of FIG. 5 and corresponding front and top views, respectively, in accordance with various embodiments.
Figure 7B:
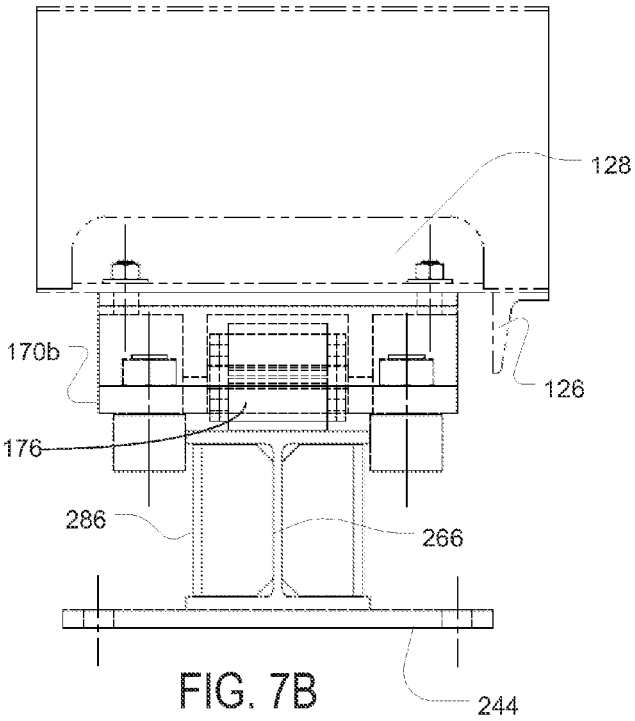
Figure 7C:
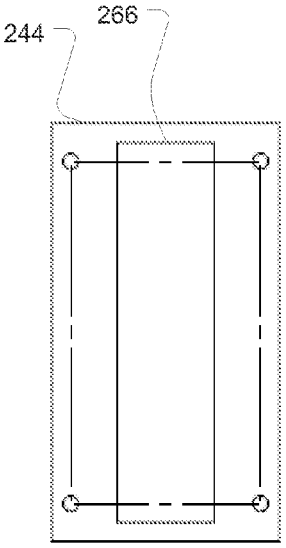

In various embodiments, one or both of rails 252/254 may include temporary rail sections between permanent rail sections. Optionally, the temporary rail sections may be removed after the veneer dryer has been moved into the desired position at installation site 236 and the movers are positioned on the corresponding permanent rail sections (e.g., rail sections 266). FIGS. 6A and 7A illustrate sectional views of rail sections taken along lines A-A and B-B of FIG. 5, respectively, with corresponding front and top views shown in FIGS. 6B-6C and 7B-7C, all in accordance with various embodiments.

As illustrated, in various embodiments one or more permanent rail sections 266 may be positioned on pads 244. Movers 170*a* (FIGS. 6A-6B) and 170*b* (FIGS. 7A-7B) may be positioned on permanent rail sections 266. Lateral supports 128 may be coupled with movers 170*a*/170*b*. In some embodiments, lateral supports 128 may also be coupled with other portions of the veneer dryer (e.g., longitudinal supports 124) by one or more connectors 184, such as steel plates/brackets (FIG. 6A).

Optionally, permanent rail sections 266 may include one or more plates 286. In some embodiments, plates 286 may be configured to provide additional structural support to permanent rail sections 266. In other embodiments, plates 286 may be configured for use to couple permanent rail sections 266 with other rail sections (e.g., temporary rail sections). For example, plates 286 may be provided with one or more bolts or other fasteners, and/or holes or other features designed to accommodate bolts or other fasteners.

Figure 8A:
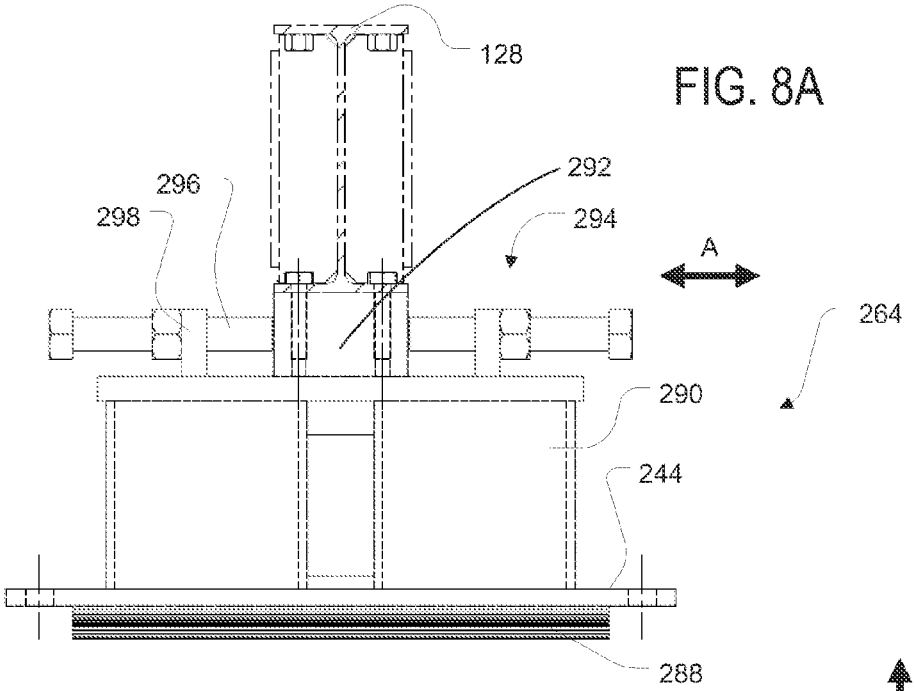
FIGS. 8A-8C illustrate a sectional view of an anchor pedestal taken along lines C-C of FIG. 5 and corresponding front and top views, respectively, in accordance with various embodiments.
Figure 8B:
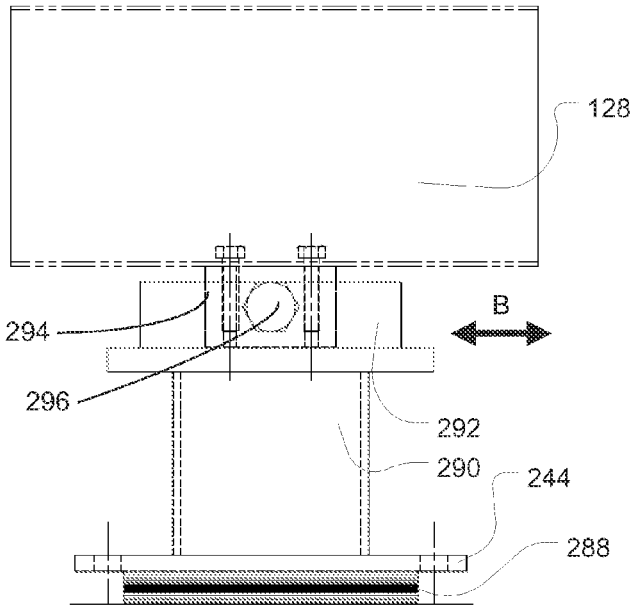
Figure 8C:
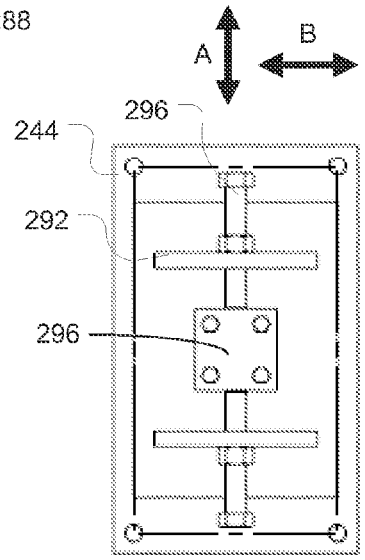

FIG. 8A illustrates a sectional view of an anchor pedestal taken along lines C-C of FIG. 5, with corresponding front and top views shown in FIGS. 8B-8C, all in accordance with various embodiments. In some embodiments, anchor pedestal 264 may include a base 290, an anchor block 294 disposed on base 290, and an adjustment assembly 294 coupled with base 290.

In various embodiments, base 290 may be constructed from concrete, metal, and/or other materials. For example, base 290 may include a concrete block or steel beam coupled at the top/sides with one or more structural reinforcements such as steel plates. In some embodiments, base 290 may be mounted on a pad 244 or other such structure. Pad 244 may be coupled with an underlying support surface, such as a foundation and/or concrete surface. In some embodiments, one or more shims 288 may be provided between pad 244 and the underlying support surface to adjust the vertical height of anchor pedestal 264. For example, shims 288 may be used to adjust the vertical height of anchor pedestal 264 such that the upper surface of the anchor block 294 matches the vertical height of the upper surfaces of movers 170.

As shown in FIG. 8A, anchor block 294 may be coupled with a portion of the veneer dryer, such as a lateral support 128 and/or a longitudinal support 124/126. In some embodiments, anchor block(s) 294 may be coupled with a lateral support 128 at or near the longitudinal center of the veneer dryer. For example, in a veneer dryer with eighteen heating/cooling sections, anchor pedestal(s) 264 may be positioned between the eighth and eleventh heating/cooling sections, and anchor block(s) 294 may be coupled with a corresponding one of the lateral supports 128.

Adjustment assembly 294 may be configured to restrict movement of anchor block 294 in one or more directions along base 290. For example, adjustment assembly 294 may be configured to restrict axial/longitudinal movement of anchor block 294 (e.g., in a direction parallel to the long axis of the veneer dryer; Arrow A, FIGS. 8A-8C). Optionally, adjustment assembly 294 may be configured to restrict axial/longitudinal movement of anchor block 294 while permitting lateral movement of anchor block 294 (e.g., in a direction perpendicular to the long axis of the veneer dryer; Arrow B, FIGS. 8A-8C).

In some embodiments, adjustment assembly 294 may include adjustable members 296 and retaining members 298. Retaining members 298 may be configured to movably couple adjustable members 296 to base 290. For example, retaining members 298 may be brackets/plates that are rigidly coupled with base 290 and have one or more openings configured to movably retain adjustable members 296. Adjustable members 296 may be disposed in/through the opening(s). In various embodiments, adjustable members 296 may be bolts, screws, or other suitable types of fasteners/connectors. In other embodiments, adjustment assembly 294 may include a linear positioner or other such mechanism.

The anchor pedestal configuration shown in FIGS. 8A-8C may allow lateral expansion of the veneer dryer during operation while restricting longitudinal movement of the corresponding portion of the veneer dryer. In other embodiments, anchor pedestal(s) 264 may have various other configurations designed to accommodate lateral expansion while restricting axial expansion. In still other embodiments, anchor pedestal(s) 264 may be positioned on one side of the track and configured to restrict both axial and lateral expansion.

In various embodiments, a source of motive force may be used to push/pull the veneer dryer (or other construct) along the track from the construction site to the desired location. Examples of sources of motive force may include, but are not limited to, a vehicle (e.g., a truck, an excavator), a driven conveyor, a winch, a pulley, animals (e.g., horses, oxen), one or more linear actuators, and other suitable means or mechanisms known for use in moving large or heavy objects. Optionally, the veneer dryer may be coupled with the source of motive force by a tow assembly configured to distribute the push/pull forces along a desired portion of the veneer dryer.

FIGS. 9A-9D illustrate an example of a tow assembly and components thereof, in accordance with various embodiments.

Figure 9A:
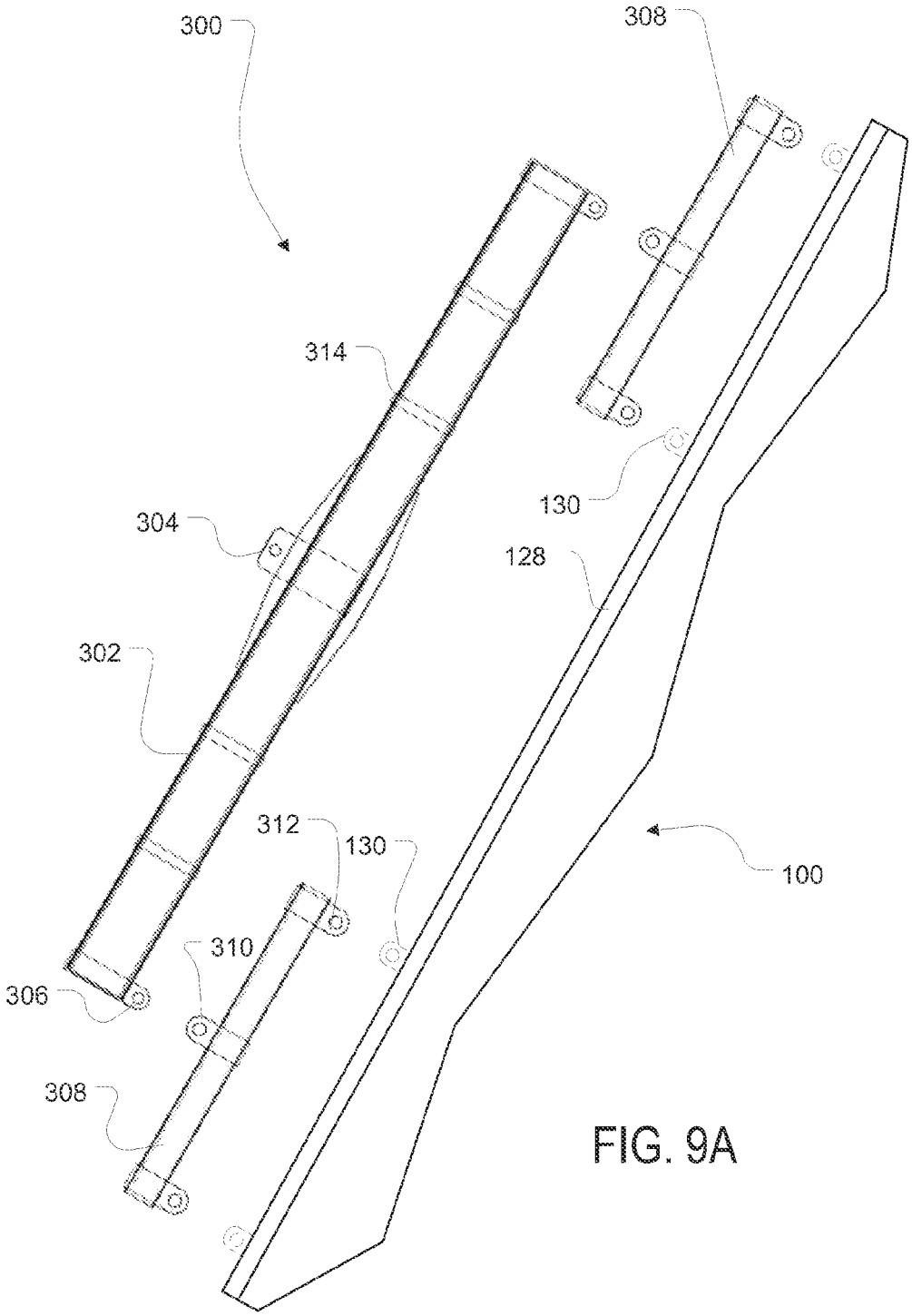
FIGS. 9A-9D illustrate schematic diagrams of a tow bar assembly, in accordance with various embodiments.
Figure 9B:
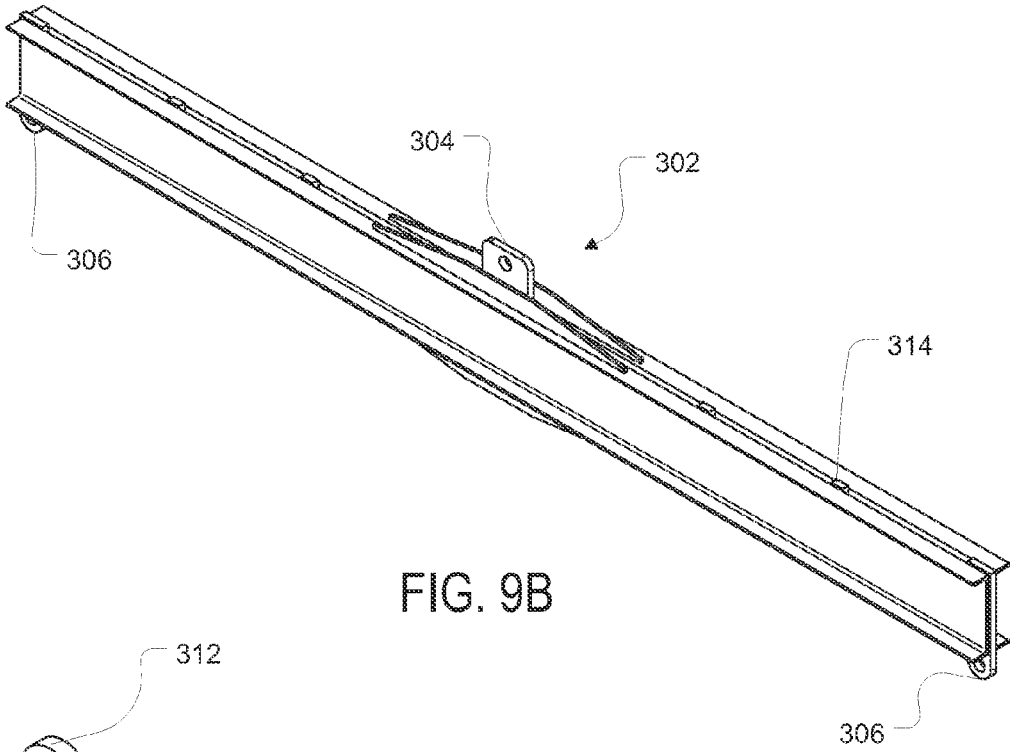
Figure 9C:
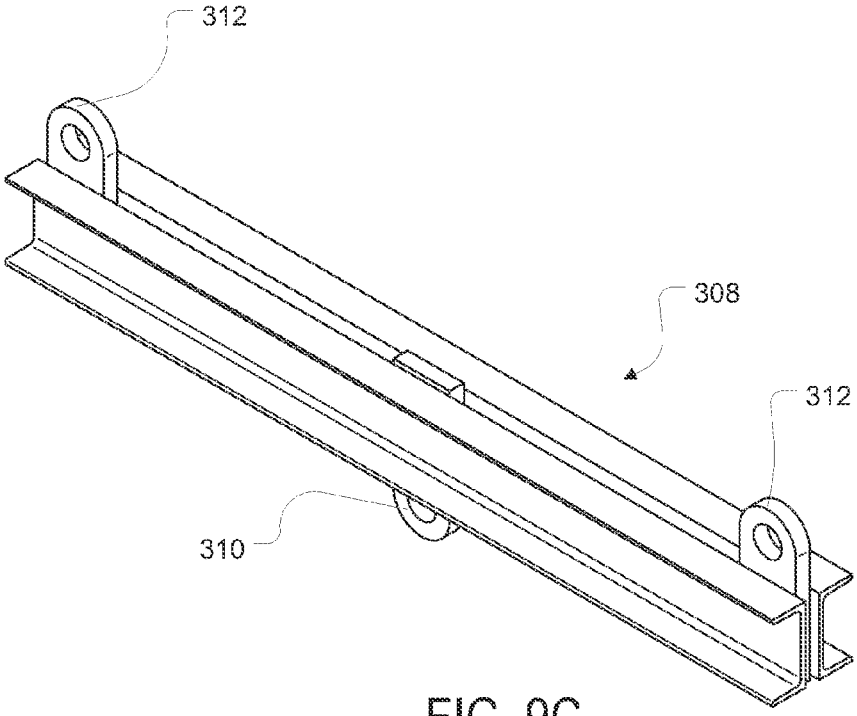

Referring first to FIG. 9A, in some embodiments a tow assembly 300 may include a primary tow bar 302 and two or more secondary tow bars 308. FIGS. 9B and 9C illustrate additional views of primary tow bar 302 and secondary tow bar 308, respectively. Primary tow bar 302 may include one or more connectors 304 on one side/end and one or more connectors 306 on the other side/end. In some embodiments, connectors 306 may be spaced apart at various intervals. Secondary tow bars 308 may include one or more connectors 310 on one side/end and one or more connectors 312 on another side/end. In some embodiments, connectors 312 may be spaced apart at intervals. For example, the distance between two connectors 312 on secondary tow bar(s) 308 may be substantially the same as the distance between two connectors 130 on an exterior portion of veneer dryer 100. Similarly, the distance between two connectors 306 on primary tow bar(s) 302 may be substantially the same as the distance between two connectors 310 on corresponding secondary tow bars 308, when secondary tow bars 308 are aligned with connectors 130 of veneer dryer 100. Such a configuration may help to distribute push/pull forces generally evenly along an end/side of veneer dryer 100, with the direction of the force remaining generally parallel to the direction of movement of the veneer dryer along the track.

In other embodiments, one tow bar (e.g., tow bar 302) may be used without secondary tow bars. For example, a single tow bar may be configured to distribute push/pull forces in a radiating or fan-like pattern, such as by having connectors 312 that are spaced at smaller intervals than corresponding connectors 130 on veneer dryer 100. Alternatively, the single tow bar may have connectors 312 spaced apart by the same intervals as corresponding connectors 130 on veneer dryer 100. In some embodiments, connectors 304/306 may extend partially or fully through primary tow bar 302. Likewise, connectors 310/312 may extend partially or fully through secondary tow bar(s) 308. In some embodiments, one or more additional supports 314 may also extend through primary tow bar 302 and/or secondary tow bar(s) 308 (FIG. 9B).

Still other embodiments may lack a tow assembly 300 and/or tow bars. For example, in some embodiments the veneer dryer may be pushed along the track by a vehicle such as an excavator or powered railcar. In other embodiments, gravity may be the source of motive force, either alone or in combination with another source of motive force. For example, the elevation of rails 252/254 at the construction site (e.g., construction site 238) and/or at middle portion 246 may be greater than the elevation of rails 252/254 at the desired location (e.g., installation site 236). One or more of the movers 170 may be blocked from moving along the track during construction, and subsequently unblocked when the construction is substantially complete. At that time, the veneer dryer may be moved along the track to the desired location by gravitational force, alone or in combination with another source of motive force. For example, legs 250 may be used to raise the track upstream of the desired location. As another example, the underlying ground/support surface at the construction site may be at a higher elevation than the desired site, and the track may be positioned on the ground/support surface without legs 250.

In some embodiments, a braking system and/or a source of opposing force may be provided to slow, stop, or reverse the motion of the veneer dryer along the track. For example, the veneer dryer may be provided with a braking system (e.g., hydraulic brakes, friction brakes) that is operable to engage the track to slow or stop the motion of the veneer dryer along the track. Alternatively, one or more chocks may be provided at intervals along the track. Optionally, as the veneer dryer approaches a chock, the chock may be uncoupled from the track (e.g., if the veneer dryer is moving at an acceptable speed) or left coupled to the track to engage and slow/stop the veneer dryer (e.g., if the veneer dryer is moving at a greater than desired speed). In other embodiments, one source of motive force may be used to move the veneer dryer along the track toward the installation site, and another source of motive force (e.g., a winch, a vehicle, linear positioners) may be used to exert force against the veneer dryer in the opposite direction. In some embodiments, some or all of the movers may be provided with a braking/locking mechanism.

Figure 9D:
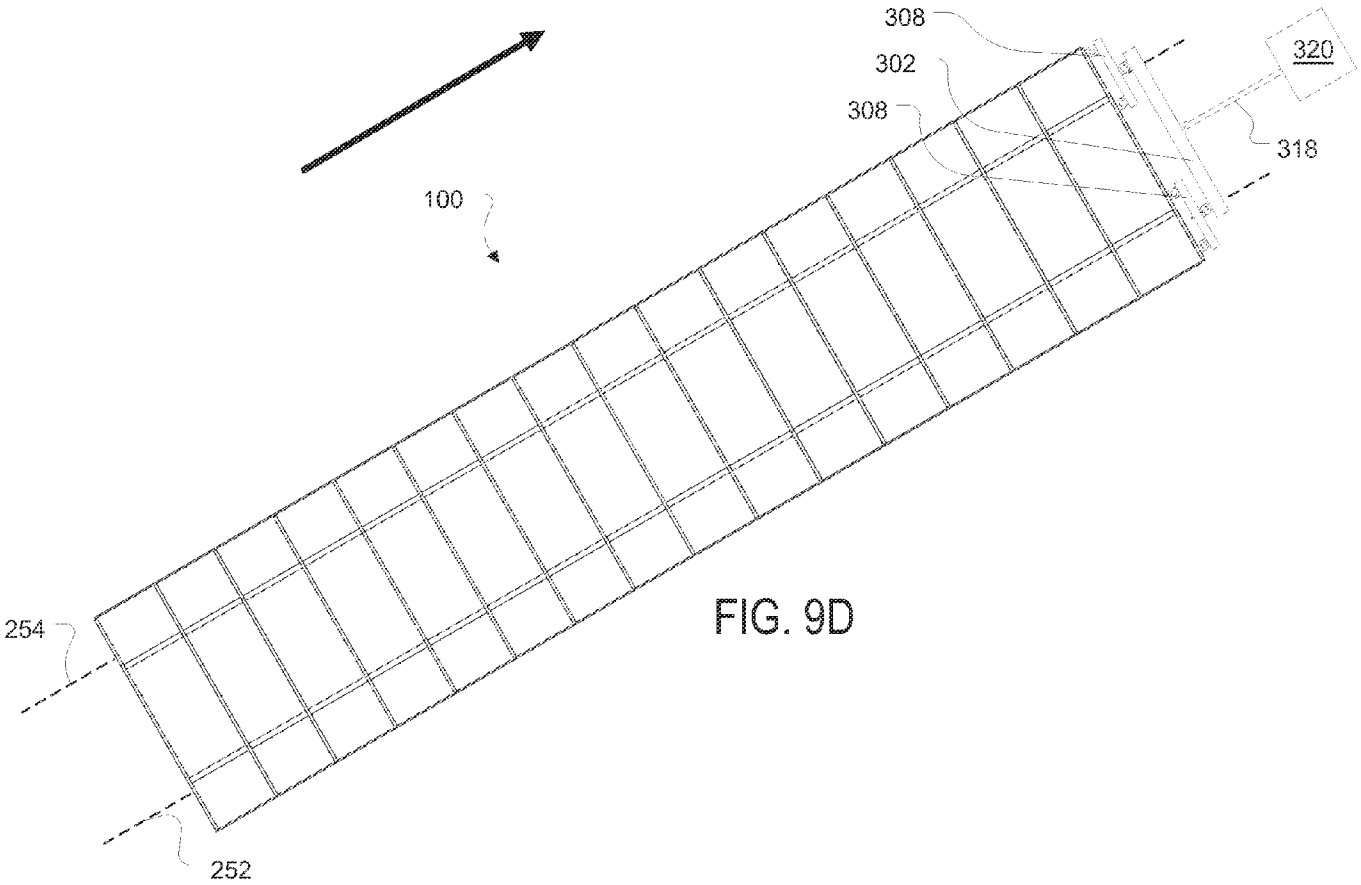

FIG. 9D illustrates a schematic view of tow assembly 300 in use, in accordance with various embodiments. In some embodiments, a source of motive force 320 may be coupled with primary tow bar 302 by a tow line 318. In some embodiments, the source of motive force 320 may be a winch. Optionally, the winch may be anchored to an underlying support, such as the foundation of installation site 236. The type of source of motive force 320 and corresponding tow line(s) 318 may vary among embodiments, as described elsewhere herein with regard to sources of motive force. Examples of suitable tow lines 318 may include, but are not limited to, a cable, a chain, an elongate bar, and similar items known for use in towing large/heavy objects. Some embodiments may lack a tow line 318.

In some embodiments, tow line 318 may be coupled with connector 304 of primary tow bar 302. Connectors 306 of primary tow bar 302 may be coupled with connectors 310 of corresponding secondary tow bars 308, and connectors 312 of secondary tow bars 308 may be coupled with corresponding connectors 130 of veneer dryer 100. In various embodiments, corresponding connectors 304/306/310/312/130 may be coupled together with one or more shackles, rings, pins, or other fasteners. For example, corresponding connectors 304/306/310/312/130 may be coupled together with shackles or other fasteners that allow tow bar 302/308 to move with respect to the other tow bar and/or veneer dryer.

The source of motive force 320 may be operated to pull tow line 318 toward the desired location of the veneer dryer (e.g., installation site 236). As a result, veneer dryer 100 may be moved on/along rails 252/254 toward the desired location. Once veneer dryer 100 has reached the desired location, one or more of tow line 318, tow assembly 300, and/or source of motive force 300 may be uncoupled from veneer dryer 100. In some embodiments, a second winch may be provided upstream of the veneer dryer and coupled to the lagging end/side of the veneer dryer. The second winch may be used to slow or stop the veneer dryer on the tracks.

Figure 10:
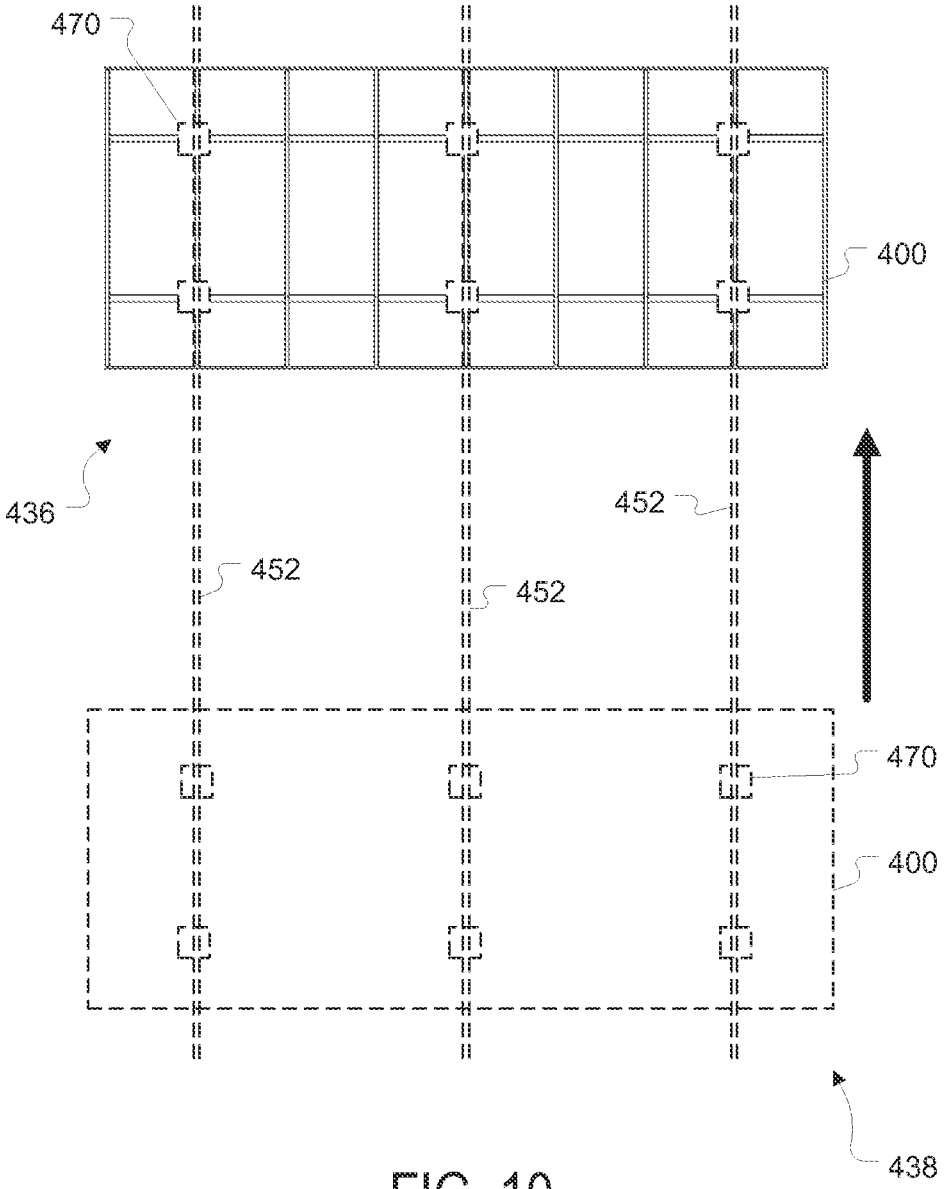
FIG. 10 illustrates a schematic view of a veneer dryer system, in accordance with various embodiments.

In some embodiments, a veneer dryer may be constructed on a track that extends generally parallel to the long axis of the veneer dryer (see e.g., FIGS. 2A-2B). In other embodiments, a veneer dryer may be constructed on a track that extends transverse or perpendicular to the long axis of the veneer dryer. Referring now to FIG. 10, movers 470 may be positioned on rails 452. Optionally, three, four, five, or more than five rails 452 may be provided. In some embodiments, a rail 452 may be provided below/between some or all of the drying/cooling sections, below/between every second drying/cooling section, below/between every third drying/cooling section, at or near the opposite ends and middle of the veneer dryer, or in various other arrangements.

In the embodiment of FIG. 10, veneer dryer 400 may have the same or similar features/configuration as described herein for veneer dryer 100. Similarly, movers 470 may have the same or similar features/configuration as described herein for any of movers 170, 170*a*, and/or 170*b*. Aside from directionality/orientation, rails 452 may have the same or similar features/configuration as described herein for rails 452/454, and installation site 436 and/or construction site 438 may have the same or similar features/configurations as described herein for installation site 136 and/or construction site 138.

Figure 11:
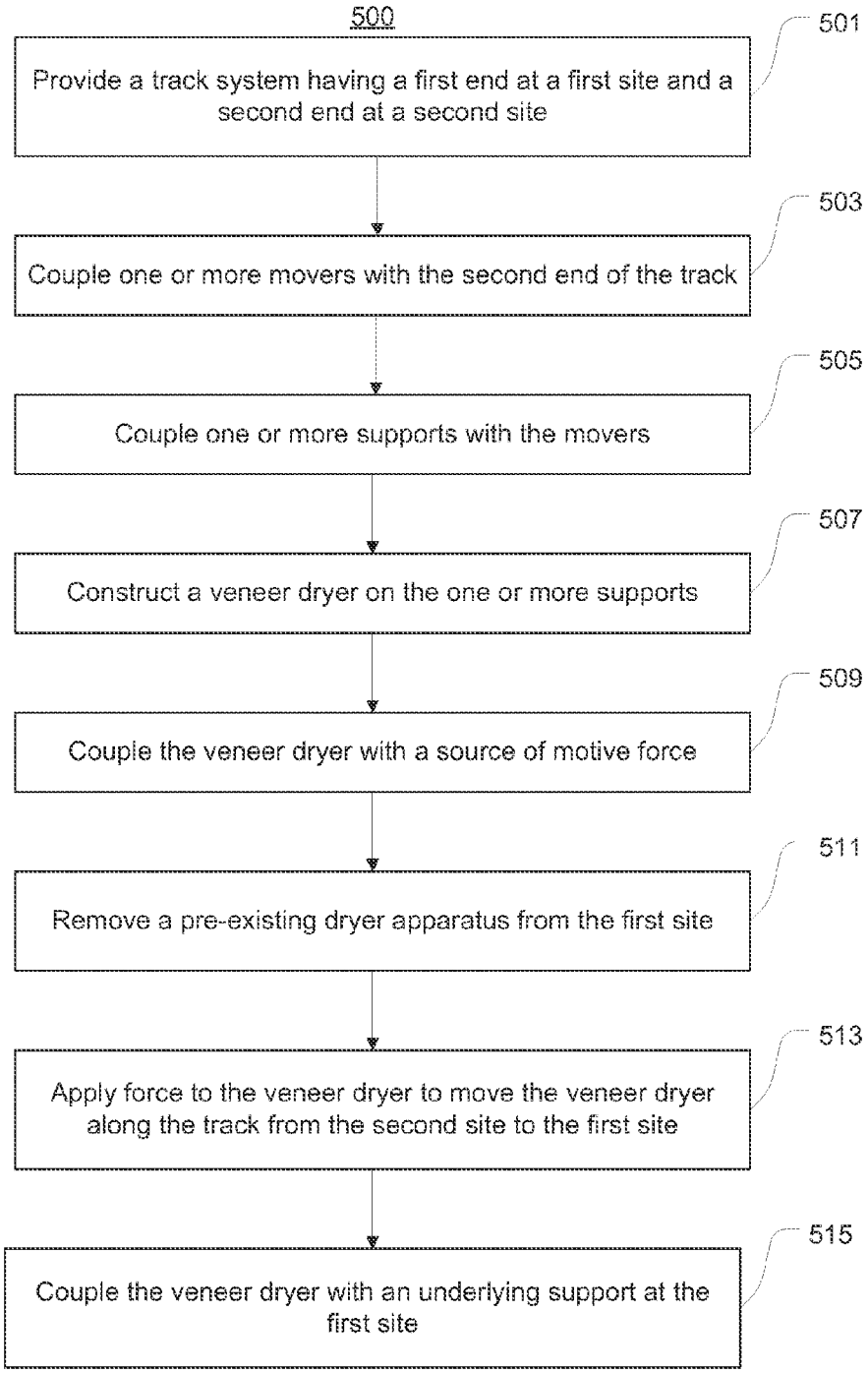
FIG. 11 illustrates a flow diagram of a method for installing, translocating, and/or replacing a veneer dryer, in accordance with various embodiments.

FIG. 11 illustrates a flow chart for a method 500 of installing, replacing, and/or moving a veneer dryer, in accordance with various embodiments. In embodiments of method 500, the veneer dryer may be located at a construction site and may be movably coupled with a track. The track may extend in a first direction from the construction site to the installation site. In various embodiments, method 500 may begin at any of blocks 501 to 515.

In some embodiments, at block 501 a track system may be provided. The track system may have a first end at an installation site (e.g., a desired location for the veneer dryer) and a second end at a construction site (e.g., a location at which the veneer dryer is built). In various embodiments, the track system may have any or all of the same or similar features as described herein for track system 240. For example, in some embodiments the track system may include two or more rails (e.g., rail 252/254, rail 452, permanent rails 266). Again, the desired location may be within an existing facility. Optionally, the desired location may be a site that is occupied by a pre-existing dryer, which may continue to be operated while a new veneer dryer is constructed at the construction site. Optionally, the construction site and the installation site may be spaced apart by a distance of at least 10 feet (e.g., 10-500 feet).

At block 503, one or more movers (e.g., movers 170, 170*a*, 170*b*, and/or 470) may be coupled with the second end of the track. In various embodiments, the movers may include one or more rotatable members movably coupled with a frame. In some embodiments, the frame may be rigidly coupled with a bottom portion of a veneer dryer, and the rotatable member(s) may be slideable/rotatable along the track. In other embodiments, the frame may be rigidly coupled with the track, and the veneer dryer may be slideable along the rotatable members.

At block 505, one or more supports (e.g., lateral supports 128 and/or longitudinal supports 124/126) may be coupled with the movers. In various embodiments, constructing the veneer dryer may include coupling an elongate support member with corresponding ones of the movers, and coupling additional components of the veneer dryer to the elongate support member to form a bottom portion of the veneer dryer. In some embodiments, the track may include two or more rails, and the elongate support member may include a plurality of lateral supports oriented transverse to the rails. In some embodiments, coupling the elongate support member with corresponding ones of the movers may include coupling a first end of the lateral supports with corresponding ones of the movers disposed on a first one of the rails, and coupling a second end of the lateral supports with corresponding ones of the movers disposed on a second one of the rails. In various embodiments, lateral supports 128, longitudinal supports 124/126, and/or other support members may be coupled with the movers substantially as described above.

At block 507, a veneer dryer (e.g., veneer dryer 100/400) may be partially or fully constructed on the one or more supports and/or on the movers. Again, the one or more supports (e.g., lateral supports 128 and/or longitudinal supports 124/126) may form part of the bottom portion of the veneer dryer.

At block 509, the veneer dryer (e.g., veneer dryer 100/400) may be coupled with a source of motive force. In various embodiments, the veneer dryer may be coupled with the source of motive force by a tow assembly (e.g., tow assembly 300). In some embodiments, coupling the veneer dryer with a source of motive force may include connecting two or more first tow bars with the veneer dryer, connecting the two or more first tow bars to a second tow bar, and coupling the second tow bar with the source of motive force.

The source of motive force may include, but is not limited to, a vehicle (e.g., a truck, an excavator), a driven conveyor, a winch, a pulley, animals (e.g., horses, oxen), one or more linear actuators, and/or gravity.

At block 511, a pre-existing veneer dryer apparatus or portion thereof may be removed from the installation site. In some embodiments, the pre-existing dryer apparatus may be removed from the installation site before moving the veneer dryer to the installation site and/or after constructing the veneer dryer on the movers. For example, the pre-existing dryer apparatus or other construct may be demolished. Alternatively, the pre-existing dryer apparatus may have previously been constructed on the track and moved into position substantially as described herein, and the new veneer dryer may have been built on the track at a later time. Therefore, the pre-existing dryer apparatus may be removed from the installation site by providing a new track that extends beyond the installation site, or that merges with the original track at the installation site, and moving the pre-existing dryer apparatus from the existing track onto the new track. Optionally, an infeed section and/or outfeed section of the pre-existing dryer apparatus may be retained at the installation site for use with the new veneer dryer.

At block 513, force may be applied to the veneer dryer to move the veneer dryer along the track from the construction site to the installation site. Applying force to the veneer dryer may include operating a source of motive force, such as a winch or a vehicle, to push/pull the veneer dryer along the track in the first direction. Depending on the initial orientation of the veneer dryer relative to the tracks and the installation site, the veneer dryer may be moved in a lineal orientation (input-end-first or output-end-first) or in a transverse orientation (see e.g., FIG. 10).

In some embodiments, the veneer dryer may be coupled with an infeed section (e.g., infeed section 112) and/or an outfeed section (e.g., outfeed section 120) before the veneer dryer is moved. In other embodiments, the veneer dryer may be constructed and moved without one or both of those sections. Optionally, one or both of those sections may be coupled with the veneer dryer after the veneer dryer is positioned at the installation site.

At block 515, the veneer dryer may be coupled with an underlying support at the installation site. In some embodiments, the underlying support may include one an anchor assembly (e.g., anchor pedestal 264) at the installation site, and coupling the veneer dryer to the underlying support at the installation site may include coupling the veneer dryer with the anchor assembly. Optionally, the anchor assembly may be configured to restrict movement of the veneer dryer in the first direction without restricting movement of the veneer dryer in a second direction generally perpendicular to the first direction. In various embodiments, the veneer dryer may be coupled with one or more anchor pedestal(s) substantially as described elsewhere herein. In other embodiments, the underlying support may include two or more rails (e.g., rail 252/254, rail 452, permanent rails 266), and coupling the veneer dryer with an underlying support at the installation site may further include fixedly coupling one or more of the movers to a corresponding one of the two or more rails after moving the veneer dryer to the installation site. For example, the mover(s) may be fixedly coupled with a corresponding one of the two or more rails by welding the mover(s) to the rail(s).

In some embodiments, the veneer dryer may also be coupled with some portion of the pre-existing dryer. For example, where the veneer dryer is constructed and moved in an output-end-first orientation (with the output end downstream of the input end), the veneer dryer may be coupled with an outfeed section of the pre-existing dryer. Where the veneer dryer is constructed in the opposite orientation and moved in an input-end-first orientation, the veneer dryer may be coupled with an infeed section of the pre-existing dryer. In other embodiments, the veneer dryer may be constructed and moved in a transverse orientation relative to the tracks and coupled with an infeed section of the pre-existing dryer, an outfeed section of the pre-existing dryer, or both.

In various embodiments, the veneer dryer may be constructed as an addition to, or a replacement for, a portion of the pre-existing dryer. In some embodiments, the veneer dryer may be constructed as an addition to increase the length of the pre-existing dryer and/or the number of heating or cooling sections. In other embodiments, the veneer dryer may be constructed as a replacement for part of the pre-existing dryer. In either case, instead of removing all or substantially the entire pre-existing dryer, an upstream portion (e.g., an end wall, an infeed/outfeed section, a heating/cooling chamber, two or more heating/cooling chambers) of the pre-existing dryer may be removed. The veneer dryer may be moved along the tracks and coupled with the remainder of the pre-existing dryer. For example, the new dryer may have a substantially complete input end and one or more heating sections, and the pre-existing dryer may have a substantially complete output end, or vice versa. As another example, the new dryer may be constructed as a plurality of heating sections and moved into place and coupled with an upstream-most heating section of the pre-existing dryer to elongate the heating zone. The newly created input end of the combined veneer dryer may be coupled with either the pre-existing infeed section or a new infeed section.

In various embodiments, any one or more of blocks 501-513 may be omitted, duplicated, and/or performed concurrently with another of blocks 501-503. Likewise, the order of any one or more of blocks 501-513 may vary among embodiments. For example, in some embodiments, operations of block 505 may be performed before, or concurrently with, block 503.

In summary, a veneer dryer (or other construct) may be constructed on a track at a construction site. During the construction, a pre-existing dryer may continue to be operated. When the new veneer dryer is partially or fully constructed, the pre-existing dryer may be removed before the new veneer dryer is towed into the desired location. Optionally, the new veneer dryer may be moved into place on the same site formerly occupied by the pre-existing dryer. This may reduce the time required for replacement of the pre-existing dryer from 18-20 weeks to 2 weeks, 12 days, 10 days, or less than 10 days. In some embodiments, the time required for replacement of a pre-existing dryer may be reduced by 80-95% as compared to prior methods. In addition, embodiments described herein may allow the facility to choose the most advantageous time for disrupting a production schedule for the replacement/installation, and allow the facility to re-use the same site and/or building structure to house the new veneer dryer.

Although certain embodiments have been illustrated and described herein, it will be appreciated by those of ordinary skill in the art that a wide variety of alternate and/or equivalent embodiments or implementations calculated to achieve the same purposes may be substituted for the embodiments shown and described without departing from the scope. Those with skill in the art will readily appreciate that embodiments may be implemented in a very wide variety of ways. This application is intended to cover any adaptations or variations of the embodiments discussed herein. Therefore, it is manifestly intended that embodiments be limited only by the claims and the equivalents thereof.

What is claimed is:

1. A method of installing a veneer dryer at a first site, wherein the veneer dryer includes a plurality of consecutive veneer dryer sections, at least some of the veneer dryer sections forming an elongate chamber with an input end, an output end, a heating zone, and a conveyor extending through the heating zone, the method comprising:

movably coupling one or more of the veneer dryer sections with a track at a second site, wherein the track extends from the second site to the first site; and moving said one or more veneer dryer sections along the track in a first direction from the second site to the first site.

2. The method of claim 1, wherein the track includes two or more rails.

3. The method of claim 2, wherein movably coupling one or more of the veneer dryer sections with the track further includes positioning a plurality of movers on the two or more rails at the second site, wherein each of the movers has one or more rotatable members and a frame; and positioning the one or more veneer dryer sections on the movers.

4. The method of claim 3, wherein positioning the one or more veneer dryer sections on the movers includes constructing the one or more veneer dryer sections on the movers after positioning the plurality of movers on the two or more rails.

5. The method of claim 4, wherein constructing the one or more veneer dryer sections includes coupling an elongate support member with corresponding ones of the movers, and coupling additional components of the veneer dryer to the elongate support member to form a bottom portion of the one or more veneer dryer sections.

6. The method of claim 5, wherein the elongate support member includes a lateral support oriented transverse to the two or more rails, and coupling the elongate support member with corresponding ones of the movers includes coupling a first end of the lateral support with a corresponding first one of the movers disposed on a first one of the rails and coupling a second end of the lateral support with a corresponding second one of the movers disposed on a second one of the rails.

7. The method of claim 1, wherein the second site and the first site are spaced apart by a distance of at least 10 feet.

8. The method of claim 1, further including removing at least a portion of a pre-existing dryer apparatus from the first site before moving the one or more veneer dryer sections to the first site.

9. The method of claim 4, further including removing at least a portion of a pre-existing dryer apparatus from the first site before moving the one or more veneer dryer sections to the first site and after constructing the one or more veneer dryer sections on the movers.

10. The method of claim 2, further including fixedly coupling one or more of the movers to a corresponding one of the rails after moving the one or more veneer dryer sections to the first site.

11. The method of claim 1, further including coupling a bottom portion of a selected one of the veneer dryer sections to an anchor assembly at the first site, the anchor assembly configured to restrict movement of the selected veneer dryer section in the first direction without restricting movement of the selected veneer dryer section in a second direction generally perpendicular to the first direction.

12. The method of claim 1, further including coupling the one or more veneer dryer sections to a source of motive force while the one or more veneer dryer sections are at the second site, wherein moving the one or more veneer dryer sections along the track includes operating the source of motive force to apply force against the one or more veneer dryer sections in the first direction.

13. The method of claim 11, wherein the source of motive force includes a winch, and coupling the one or more veneer dryer sections to the source of motive force includes coupling the veneer dryer with the winch.

14. The method of claim 12, wherein coupling the one or more veneer dryer sections with the winch includes connecting two or more first tow bars with the one or more veneer dryer sections, connecting the two or more first tow bars to a second tow bar, and coupling the second tow bar with the winch.

15. The method of claim 1, wherein the veneer dryer includes a portion of a pre-existing veneer dryer disposed at the first site, further including coupling the one or more veneer dryer sections to the portion of the pre-existing veneer driver at the first site.

16. The method of claim 15, wherein the portion of the pre-existing veneer dryer includes an infeed section or an outfeed section.

17. The method of claim 16, further including removing another portion of the pre-existing dryer apparatus from the first site before moving said one or more veneer dryer sections to the first site.

18. The method of claim 1, wherein the one or more veneer dryer sections includes at least one section of the heating zone.

19. The method of claim 1, wherein the elongate chamber has a cooling zone between the heating zone and the output end, and wherein the one or more veneer dryer sections includes at least one section of the cooling zone.

20. The method of claim 1, wherein the veneer dryer further includes an infeed section and an outfeed section, and wherein said one or more veneer dryer sections includes the infeed section or the outfeed section.

21. The method of claim 1, wherein said one or more veneer dryer sections includes substantially all of the veneer dryer sections that form the elongate chamber.

22. The method of claim 1, further including coupling the one or more veneer dryer sections to an underlying support surface at the first site.

23. The method of claim 22, wherein the underlying support surface is a foundation or floor surface, and the track includes two or more rails, and wherein coupling the one or more veneer dryer sections to the underlying support surface includes coupling a selected one of the veneer dryer sections to an anchor pedestal that is fixedly coupled to the underlying support surface.

24. The method of claim 23, wherein the selected one of the veneer dryer sections is a middle section of the elongate chamber.

25. The method of claim 23, wherein coupling the one or more veneer dryer sections to an underlying support surface at the first location further includes coupling the selected one of the veneer dryer sections to a second anchor assembly at the first site, and wherein the first and the second anchor assemblies are disposed on opposite sides of the track.

26. The method of claim 1, further including installing the track, wherein the track includes two or more rails.

27. The method of claim 26, wherein movably coupling the one or more veneer dryer sections to the track includes supporting the one or more veneer dryers on the rails on a plurality of movers, and wherein each of the movers includes a frame and a rotatable member coupled to the frame.

28. The method of claim 27, wherein the rotatable member is an endless loop rotatably coupled to the corresponding frame, and wherein movably coupling the one or more veneer dryer sections to the track includes positioning the endless loops on the track and coupling the frames to a bottom portion of the one or more veneer dryer sections, such that the one or more veneer dryer sections is supported on the rails by the movers.

29. The method of claim 1, wherein moving the one or more veneer dryer sections along the track from the second site to the first site includes moving the one or more veneer dryer sections a distance that is greater than the length of the one or more veneer dryer sections.

30. The method of claim 29, wherein the distance is 10-500 feet.

* * * * *